US008272730B2

(12) United States Patent
Hori

(10) Patent No.: US 8,272,730 B2
(45) Date of Patent: Sep. 25, 2012

(54) FIXING PROCESSING APPARATUS, INKJET RECORDING APPARATUS AND FIXING PROCESSING METHOD

(75) Inventor: Hisamitsu Hori, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 229 days.

(21) Appl. No.: 12/705,092

(22) Filed: Feb. 12, 2010

(65) Prior Publication Data

US 2010/0208021 A1 Aug. 19, 2010

(30) Foreign Application Priority Data

Feb. 13, 2009 (JP) ..... 2009-031812

(51) Int. Cl.
*B41J 2/01* (2006.01)

(52) U.S. Cl. ..... 347/102; 347/104

(58) Field of Classification Search ..... None
See application file for complete search history.

(56) References Cited

U.S. PATENT DOCUMENTS 5,210,580 A * 5/1993 Aslam et al. ..... 399/328
5,247,336 A * 9/1993 Mills, III ..... 399/70
2001/0023265 A1* 9/2001 Hidaka et al. ..... 523/161
2002/0027587 A1* 3/2002 Sugaya et al. ..... 347/104
2003/0063916 A1* 4/2003 Katayanagi et al. ..... 399/44
2006/0056886 A1* 3/2006 Ohishi et al. ..... 399/322
2006/0187254 A1* 8/2006 Yamanobe ..... 347/15
2007/0025782 A1* 2/2007 Tamura et al. ..... 399/322

FOREIGN PATENT DOCUMENTS

JP 2002-283553 A 10/2002
JP 2004-188867 A 7/2004
JP 2005266300 A * 9/2005

* cited by examiner

*Primary Examiner* — Stephen Meier
*Assistant Examiner* — Leonard S Liang
(74) *Attorney, Agent, or Firm* — Birch, Stewart, Kolasch & Birch, LLP

(57) ABSTRACT

The fixing processing apparatus includes: a conveyance device which conveys a recording medium in a prescribed conveyance direction along a conveyance path, a desired image having been recorded in an image formation region on an image formation surface of the conveyed recording medium; a heat and pressure fixing device which is arranged in the conveyance path and carries out heat and pressure fixing process in which the image formation surface of the recording medium is subjected to at least one of heating process, pressing process and non-pressing process, the heat and pressure fixing device applying pressure to the image formation region in the pressing process, the heat and pressure fixing device applying no pressure to the image formation region in the non-pressing process; and a setting device which sets a temperature of the heat and pressure fixing device to be higher in the non-pressing process than in the pressing process.

20 Claims, 19 Drawing Sheets

FIXING PROCESSING APPARATUS, INKJET RECORDING APPARATUS AND FIXING PROCESSING METHOD

BACKGROUND OF THE INVENTION

1. Field of the Invention

The present invention relates to a fixing processing apparatus, an inkjet recording apparatus and a fixing processing method, and more particularly to technology for drying ink and fixing an image after forming an image.

2. Description of the Related Art

Currently, an inkjet recording apparatus which uses water-based ink is desirable for use as a general image recording apparatus. In an inkjet recording apparatus which uses water-based ink, it is desirable to carry out a compulsory drying process by applying heat to a recording medium after forming an image thereon, in order to raise the printing speed. Furthermore, in order to improve the light resistance and wear resistance of the recorded image, it is effective to record an image with a liquid, such as ink, that contains polymer particles, and then carry out processing for forming a film of the polymer particles by applying heat and pressure after the recording of the image.

In order to carry out successful image formation onto media of various types (in particular, coated paper for printing) using an inkjet method, a direct recording method employing an aggregating treatment agent which aggregates the ink has been investigated. In particular, a desirable method is one according to which an image is formed by ejecting and depositing droplets of ink having added polymer particles for fixing, onto a recording medium on the surface of which a layer of aggregating treatment agent has been formed by depositing and then drying an aggregating treatment agent having added polymer particles of latex, or the like, removing the water content from the recording medium after the ink has aggregated, and also fixing the ink to the recording medium while forming a film of the polymer particles, by means of a heating process or pressing process.

It is desirable to use a so-called coated printing paper as the recording medium in an inkjet recording apparatus to be used alternatively to a conventional printing apparatus. In this case, it is necessary to carry out a gloss fixing process over a broad width, in accordance with different paper types, such as art paper, matt-coated paper, gloss-coated paper, gloss-matt-coated paper, fine-coated paper, and the like.

However, it is difficult to carry out a suitable fixing process in a stable fashion, in respect of these differences, simply by adjusting the temperature and pressure alone. In particular, matt-coated paper and fine-coated paper have large indentations in the coating layer and if an aggregating treatment agent is applied with a roller, or the like, a thick layer of the aggregating treatment agent is liable to form and problems are liable to occur due to the aggregating treatment agent permeating into the paper and damaging the coating layer or the interface between the coating layer and the base paper layer, leading to roller offset, and the like, when heat and pressure fixing is then carried out. This is especially marked in cases where the coating layer is thin.

Japanese Patent Application Publication No. 2002-283553 discloses technology for an inkjet recording apparatus which records an image by ejecting and depositing ink onto a recording medium having a resin layer on the surface thereof, wherein the glossiness of the image surface of the recording medium is controlled by controlling at least one of the heating temperature, the applying pressure, the recording medium conveyance speed, and the pressing force, applied to the recording medium. This inkjet recording apparatus is able to change the degree of glossiness by adjusting the fixing temperature, pressure and time; however, in cases where low gloss is required, such as text images or matt-coated paper, the contact with the recording medium is liable to become instable if the pressure is simply reduced. Moreover, if the temperature is simply reduced, then the effects on the drying and permeation of the ink during fixing are also reduced, and the ink fixing properties are liable to decline, whereas if the conveyance speed is raised, then problems such as conveyance errors, or the like, become liable to occur.

Furthermore, in a composition where image formation is carried out after applying aggregating treatment agent to a matt-coated paper or fine-coated paper, the applied amount of aggregating treatment agent is liable to become large due to the indentations in the surface of the recording medium, and therefore problems such as roller offset are liable to occur due to damage to the coating layer and the interface between the coating layer and the base paper layer caused by the permeation of the solvent component of the aggregating treatment agent.

Japanese Patent Application Publication No. 2004-188867 discloses technology for an inkjet recording image forming apparatus which forms an image by ejecting and depositing ink onto a recording medium and promotes drying by heating the ink on the recording medium, wherein, if the type of recording medium is glossy paper, then the heating temperature is set to a low temperature compared to when using normal paper, thereby avoiding adverse effects on the coating layer due to heat, and avoiding the occurrence of image non-uniformities or detachment of the coating layer. When this technology is applied to the gloss processing of coated paper; however, even if a heating temperature lower than the melting point of the resin constituting the coating layer is set universally, it is difficult to adjust the glossiness in accordance with the type of surface of, for instance, matt-coated paper and gloss coated paper.

SUMMARY OF THE INVENTION

The present invention has been contrived in view of these circumstances, an object thereof being to provide a fixing processing apparatus, an inkjet recording apparatus and a fixing processing method whereby glossiness can be maintained while also securely fixing ink to recording media for printing of various types.

In order to attain the aforementioned object, the present invention is directed to a fixing processing apparatus, comprising: a conveyance device which conveys a recording medium in a prescribed conveyance direction along a conveyance path, a desired image having been recorded in an image formation region on an image formation surface of the conveyed recording medium; a heat and pressure fixing device which is arranged in the conveyance path and carries out heat and pressure fixing process in which the image formation surface of the recording medium is subjected to at least one of heating process, pressing process and non-pressing process, the heat and pressure fixing device applying pressure to the image formation region while making contact with the image formation surface at a contact position in the conveyance path in the pressing process, the heat and pressure fixing device applying no pressure to the image formation region in the non-pressing process; a switching device which switches between pressing and separation of the heat and pressure fixing device with respect to the recording medium; a switching control device which controls the switching device in such a manner that the recording medium and the heat and pressure fixing device are mutually separated in the non-pressing process; and a setting device which sets a temperature of the heat and pressure fixing device to be higher in the non-pressing process than in the pressing process.

According to this aspect of the present invention, in the case of the non-pressing process in which pressure is not applied, damage to the image, such as roller offset (for example, on the coating layer of low-gloss paper) is reduced by separating the heat and pressure fixing device from the recording medium, and therefore the glossiness of the image surface is stable. Furthermore, by raising the set temperature when the heat and pressure fixing device is separated, the drying and fixing of the image are carried out reliably by means of radiated heat. Moreover, soiling of the heat and pressure fixing device due to drying defects is prevented.

Preferably, the fixing processing apparatus further comprises an air emitting device which emits air toward the recording medium and is arranged in the conveyance path on a downstream side of the heat and pressure fixing device in terms of the conveyance direction.

According to this aspect of the present invention, in the case of the non-pressing, air is emitted between the recording medium and the heat and pressure fixing device, thereby promoting drying of the image and preventing floating up of the recording medium. Furthermore, in the case of the pressing process, air is emitted onto the contact position between the recording medium and the heat and pressure fixing device, thereby improving the separating characteristics of the recording medium.

Preferably, in the non-pressing process, the switching control device controls the switching device in such a manner that the heat and pressure fixing device is pressed against the recording medium immediately after the image formation region has passed the contact position.

According to this aspect of the present invention, the air flow emitted from the emitting device does not strike a localized portion of the heat and pressure fixing device, and therefore localized heating (cooling) of the heat and pressure fixing device is suppressed and improvement in the efficiency of use of the heat can be expected. Furthermore, floating up of the trailing end portion of the recording medium is suppressed.

Preferably, in the non-pressing process, the switching control device controls the switching device in such a manner that the heat and pressure fixing device is separated from the recording medium after a trailing end portion of the recording medium has passed the contact position and before a leading end portion of a succeeding recording medium arrives at the contact position.

According to this aspect of the present invention, interference between the next recording medium (the holding member holding the leading end portion of the next recording medium) and the heat and pressure fixing device is prevented.

Preferably, the switching control device controls the switching device in such a manner that the recording medium and the heat and pressure fixing device are mutually separated at least when using one of a fine-coated paper and a matt-coated paper as the recording medium.

According to this aspect of the present invention, a desirable heat and pressure fixing process (glossiness adjustment) is carried out in respect of the recording medium of a type which would be damaged by the application of pressure.

Preferably, in a case where a liquid used in the image contains polymer particles, the heat and pressure fixing processing device imparts, to the recording medium, a temperature not lower than a minimum film forming temperature of the polymer particles.

According to this aspect of the present invention, the polymer particles form a film, desirable glossiness is obtained, and the fixing properties of the image are also improved.

Preferably, in a case where a liquid used in the image contains polymer particles, the heat and pressure fixing processing device imparts, to the recording medium, a temperature not lower than a glass transition point of the polymer particles.

According to this aspect of the present invention, the film formation of the polymer particles progresses yet further, and the fixing properties of the liquid are further improved.

Preferably, in the pressing process, the switching control device controls the switching device in such a manner that the heat and pressure fixing device is pressed against the recording medium immediately before the image formation region arrives at the contact position, and the heat and pressure fixing device is separated from the recording medium immediately after the image formation region has passed the contact position.

According to this aspect of the present invention, when carrying out the pressing process, distortion due to pressing is eliminated (stress is released) and air is allowed to escape, for each image (recording medium).

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS

General Composition of Inkjet Recording Apparatus

Figure 1:
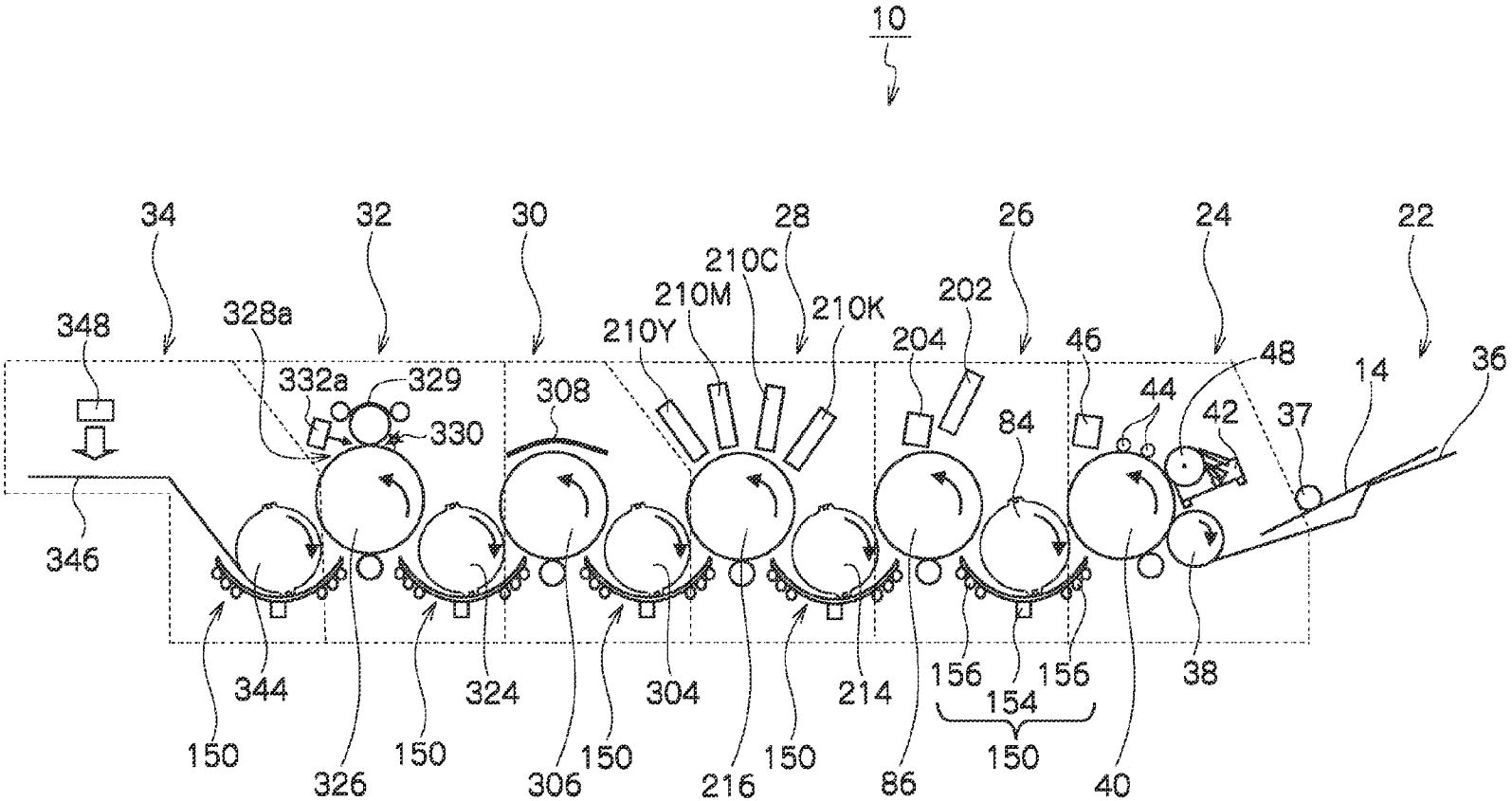
FIG. 1 is a general schematic drawing of an inkjet recording apparatus according to an embodiment of the present invention.

FIG. 1 is a diagram of the general composition of an inkjet recording apparatus according to an embodiment of the present invention. As illustrated in FIG. 1, the inkjet recording apparatus 10 in the present embodiment is an inkjet recording apparatus using a pressure drum direct printing method employing a pressure drum, which is one mode of a direct printing method of forming an image directly on a recording medium 14.

The inkjet recording apparatus 10 includes: a paper supply unit 22, which supplies the recording medium 14; a permeation suppression processing unit 24, which carries out permeation suppression processing on the recording medium 14; a treatment agent deposition unit 26, which deposits treatment agent, such as an ink aggregating agent, onto the recording medium 14; a print unit 28, which forms an image by depositing color inks onto the recording medium 14; a solvent drying unit 30, which dries the solvent of the color inks; a heat and pressure fixing unit 32, which applies heat-pressure fixing treatment to the recording medium 14 on which the image has been formed (to make the image permanent and to perform gloss adjustment treatment); and an output unit 34 which conveys and outputs the recording medium 14 on which the image has been fixed.

The paper supply unit 22 is provided with a paper supply tray 36, which supplies recording media 14 in the form of cut sheets. The recording medium 14 is conveyed out from the paper supply tray 36 with an adhesive roller 37, and the recording medium 14 is then transferred through a transfer drum 38 to a pressure drum 40 of the permeation suppression processing unit 24 in a state where the leading end portion of the recording medium 14 is gripped with a griper (not shown) arranged on the transfer drum 38. The recording medium 14 is placed on the circumferential surface of the pressure drum (a permeation suppression processing drum) 40 at a transfer position of the recording medium 14 between the transfer drum 38 and the pressure drum 40.

The inkjet recording apparatus 10 uses an aggregating treatment agent with the object of achieving good image formation onto various media using an inkjet method. In particular, a method is employed in which an aggregating treatment agent to which luster stabilizing polymer particles (Lx) have been added is deposited and dried on the recording medium, droplets of ink to which polymer particles for fixing have been added are then ejected and deposited onto the recording medium to form an image, the ink having aggregated is then heated to remove the water component while melting the polymer particles, and then the heat-pressure fixing treatment to make the image permanent is performed by applying heat and pressure to fix.

Description of Permeation Suppression Processing Unit

The permeation suppression processing unit 24 is provided with a liquid application device 42, a paper pressing member 44 and a permeation suppression agent drying unit 46 respectively at positions opposing the circumferential surface of the pressure drum 40, in this order from the upstream side in terms of the direction of rotation of the pressure drum 40 (the counter-clockwise direction in FIG. 1).

Figure 2:
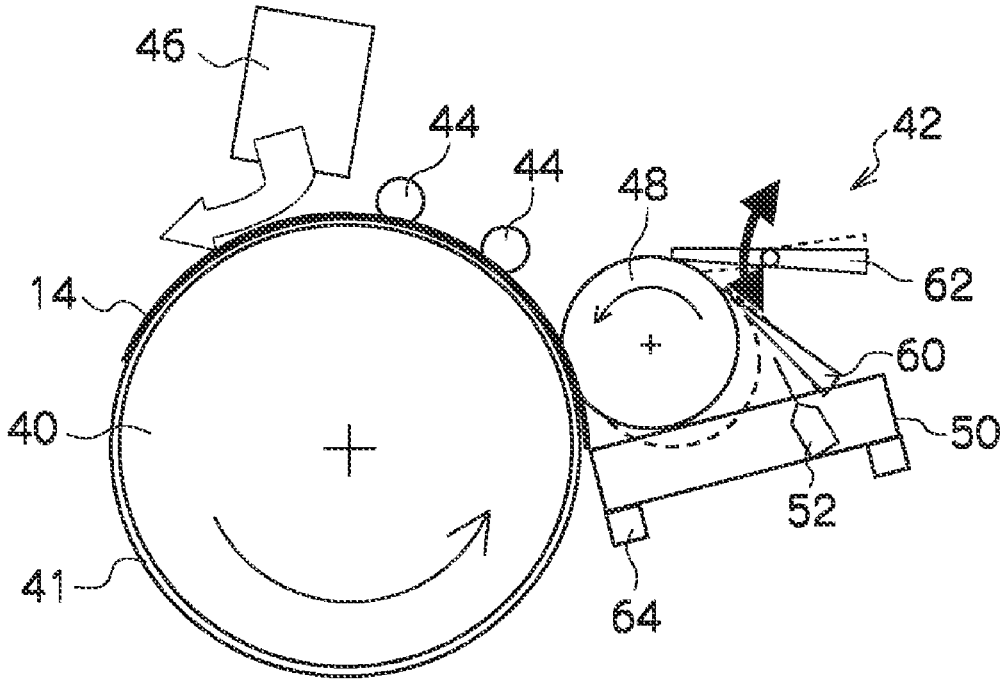
FIG. 2 is a compositional diagram illustrating a liquid application device used in a permeation suppression agent application unit.

FIG. 2 is a schematic drawing of the permeation suppression processing unit 24. As illustrated in FIG. 2, the liquid application device 42 is a device which applies a permeation suppression agent selectively to a desired region of the recording medium 14 that moves in rotation while being held by the gripper (not shown) of the pressure drum 40, by abutting a spiral roller 48 having a spiral groove formed in the outer circumference by form rolling, or the like, against the rotating pressure drum 40, and driving the spiral roller 48 to rotate at a prescribed uniform speed in a direction (the counter-clockwise direction in FIG. 2) opposite to the direction of rotation of the pressure drum 40.

The circumferential surface of the pressure drum 40 is covered with an elastic layer 41, whereby positional deviation between the pressure drum 40 and the spiral roller 48 is relieved and the wrapping of the recording medium 14 is stabilized. By using an elastic body having a hardness of 20° to 80° as the elastic layer 41 arranged on the circumferential surface of the pressure drum 40, the contact of the spiral roller 48 is stabilized and uniform application of the permeation suppression agent is achieved. Furthermore, by using for the material of the elastic layer 41 arranged on the circumferential surface of the pressure drum 40, any one of fluoro rubber, urethane rubber, silicone rubber, a fluoro elastomer, or a silicone elastomer, the surface tension (surface energy) can be set to 10 mN/m to 40 mN/m, liquid repelling properties can also be guaranteed, and hence the circumferential surface of the pressure drum 40 has excellent cleaning properties. This is also desirable since it improves the contact properties of the wrapped paper on the drum.

As illustrated in FIG. 2, a liquid spraying unit 52 sprays the permeation suppression agent toward the vicinity of the front end of a squeegee blade 60 from below the spiral roller 48. The spraying pressure is controlled in such a manner that the spraying angle is set so as to achieve an application width which matches the width of the image forming region. In other words, the liquid spraying unit 52 forms a supply width control device which controls the width over which the permeation suppression agent is supplied on the outer circumferential surface of the spiral roller 48.

In the present embodiment, the spiral roller 48 that is formed with the spiral grooves is used, and therefore it is possible to reduce spilling of the permeation suppression agent in the breadthways direction by means of the projection-recess shape of the grooves. Therefore, width control is further improved, and due to the smoothing effects of the coated paper, the contact friction can be reduced even in portions in the width direction where liquid is not applied.

Furthermore, in the present embodiment, from the viewpoint of controlling the range of application of the permeation suppression agent in the direction of conveyance of the recording medium 14 (hereinafter also referred to as "medium conveyance direction"), a main blade 62 forming a blade member is disposed in the liquid application device 42 on the downstream side of the squeegee blade 60 in terms of the direction of rotation of the spiral roller 48, and is controlled so as to abut against and separate from the outer circumferential surface of the spiral roller 48.

By abutting the main blade 62 against a partial range of the outer circumferential surface of the spiral roller 48, it is possible to remove liquid that has been applied to the outer circumferential surface including the permeation suppression agent inside the grooves of the spiral roller 48 (blade abutting step).

By controlling the range in which the liquid is removed from the spiral roller 48 by the main blade 62, it is possible to control the range (the region in the medium conveyance direction) of application of the permeation suppression agent to the recording medium 14 (blade abutting and separation control step).

More specifically, the main blade 62 is abutted against the outer circumferential surface of the spiral roller 48 in the region corresponding to the non-image formation region on the recording medium 14, and the main blade 62 is separated from the outer circumferential surface of the spiral roller 48 in the region corresponding to the image formation region on the recording medium 14. Thus, the treatment liquid is not applied to the non-image formation region on the recording medium 14, and it is possible to selectively apply the treatment liquid to the image formation region only.

According to this mode, it is possible to control application of the permeation suppression agent onto unwanted regions, and even when paper is supplied in a non-continuous fashion, for instance, in the form of cut paper, it is possible to prevent adherence of the permeation suppression agent to the pressure drum 40. Consequently, the operation of the apparatus is stabilized, and the reliability over time in terms of soiling and corrosion is improved. As illustrated in FIG. 2, a liquid discharge port 64 is formed in the bottom part of a container 50, and this liquid discharge port 64 is connected to a recovery tank through a discharge valve (not shown). The recovered liquid can be reused as liquid for application.

As the permeation suppression agent used in the present embodiment, it is desirable to use a latex solution containing polymer particles of LX-1 indicated in Table 1 below, or the like. Examples of the liquid preparation are described in the item of "Preparation of liquids, (1) Preparation of permeation suppression agent" below.

TABLE 1

| Category | Composition | Particle size (diameter) | Melting point |
|---|---|---|---|
| LX-1 | Low-molecular-weight polyethylene | 4 μm | 110° C. |
| | Low-molecular-weight polyethylene | 1 μm | 110° C. |
| | Paraffin wax | 0.3 μm | 66° C. |

Of course, the permeation suppression agent is not limited to being a latex solution, and for example, it is also possible to use flat sheet-shaped particles (e.g., mica), or a hydrophobic agent (e.g., a fluoro coating agent), or the like.

The paper pressing member 44 (see FIG. 2) is disposed to the downstream side of the liquid application device 42 that applies the permeation suppression agent. The paper pressing member 44 is a roller for feeding the recording medium 14 in the direction of rotation of the pressure drum 40, while pressing on either both ends or the trailing end of the recording medium 14 which has been supplied to the circumferential surface of the pressure drum 40.

The permeation suppression agent drying unit 46 is provided with a heater of which the temperature is adjustable in the range of 50° C. to 130° C., and a fan for blowing an air flow in the downstream direction at a rate of 5 m/s to 50 m/s. When the recording medium 14 held on the pressure drum 40, which is the application drum, passes downstream from a position opposing the permeation suppression agent drying unit 46, a heated air flow heated to 50° C. to 130° C. by means of the heater is directed by the fan onto the recording medium 14, thereby heating the recording medium 14, and the permeation suppression agent is pre-dried.

The treatment liquid deposition unit 26 is arranged after the permeation suppression processing unit 24. A transfer drum 84 is provided between the pressure drum 40 of the permeation suppression processing unit 24 and a pressure drum 86 of the treatment liquid deposition unit 26 so as to lie in contact with both of these drums. By this means, after carrying out the permeation suppression processing and pre-drying, the recording medium 14 held on the pressure drum 40 of the permeation suppression processing unit 24 is transferred to the pressure drum 86 of the treatment liquid deposition unit 26 through the transfer drum 84, by means of a gripper 91 or a gripper 92 (not shown in FIG. 1, and shown in FIG. 3).

Structure of Transfer Drum

Here, an embodiment of the structure of the transfer drum 84 will be described.

Figure 3:
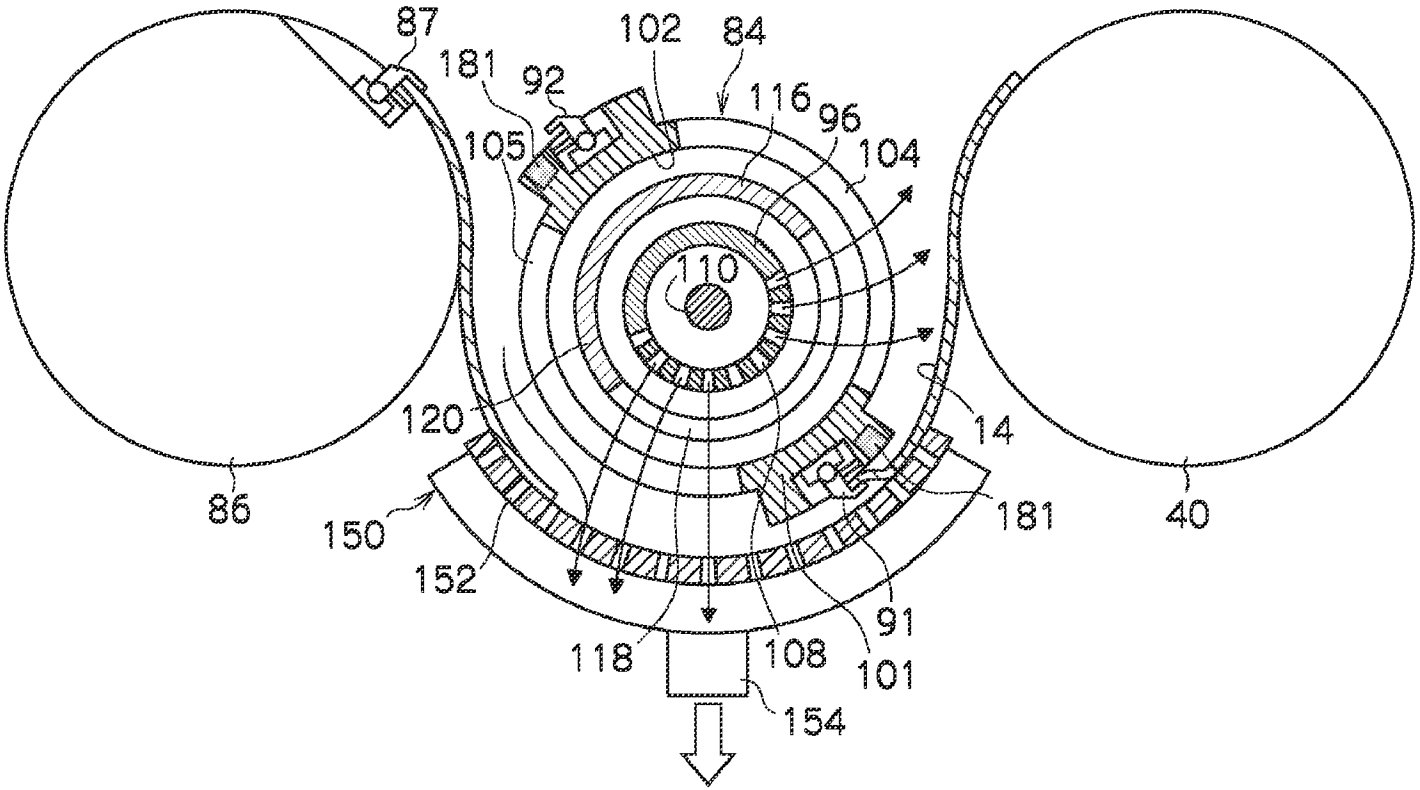
FIG. 3 is a cross-sectional diagram illustrating the structure of a transfer drum in the permeation suppression processing unit in FIG. 1.

FIG. 3 is a cross-sectional diagram illustrating details of an embodiment of the structure of the transfer drum 84.

FIG. 3 depicts a state where a preceding recording medium (on the left-hand side in FIG. 3) is being transferred from the transfer drum 84 to the pressure drum 86 while the leading end portion of the preceding recording medium is conveyed by being gripped by a gripper 87 of the pressure drum 86, and a following recording medium (on the right-hand side in FIG. 3) is being transferred from the pressure drum 40 to the transfer drum 84 while the leading end portion of the following recording medium is conveyed by being gripped by a gripper 91 of the transfer drum 84.

As illustrated in FIG. 3, the grippers 91 and 92 for gripping and thereby holding and conveying the recording medium 14 (hereinafter, also called "paper") are disposed at two symmetrical positions on the outer circumferential portion of the transfer drum 84. A heated air flow emission member 96 for emitting a heated air flow for drying onto the recording medium 14 is fixed inside the transfer drum 84 which is provided with the grippers 91 and 92. Furthermore, opening sections 104 and 105 through which this heated air flow passes are formed on the region of the circumferential surface of the transfer drum 84 apart from two gripper support sections 101 and 102 on the transfer drum 84.

The heated air flow emission member 96 has a round tubular shape which is coaxial with the transfer drum 84, and a plurality of holes 108 forming heated air blowing ports are formed in a partial region of the circumferential surface thereof (the lower side region of the circumferential surface in FIG. 3).

A heater 110 is provided inside the heated air flow emission member 96, and the air heated by the heater 110 is emitted outside the transfer drum 84 through the holes 108 of the heated air flow emission member 96 and a passage opening 118 of an emission restricting member 116. The emission restricting member 116 has a shielding portion 120 which shuts off the passage of heated air, so as to restrict the direction to emit the heated air. The emitting directions of the heated air are represented with arrows in FIG. 3.

A conveyance guide 150 to which the recording medium 14 is electrostatically attracted is provided in a position opposing the transfer drum 84 having the composition described above. In the conveyance guide 150, a plurality of apertures (discharge holes 152) through which the above-described heated air is discharged are arranged following the breadthways direction and the conveyance direction. The conveyance guide 150 is fixed to a prescribed position which composes the conveyance path of the recording medium 14. The heated air flowing through the discharge holes 152 to the conveyance guide 150 is discharged through a discharging connection port 154 of the conveyance guide 150.

Furthermore, a heating device 156 of an electromagnetic induction type is provided in the conveyance guide 150 (see FIG. 1), and the recording medium 14 which is conveyed in contact with the conveyance guide 150 is heated to a temperature of 50° C. to 90° C.

The surface of the recording medium 14 that has been transferred to the transfer drum 84 by the grippers 91 and 92 is heated and dried by the heated air flow emitted from the transfer drum 84 while being electrostatically attracted to the conveyance guide 150. In this, since sheets of the recording medium 14 (paper) are conveyed at an interval apart, the emitted heated air flow is discharged through the holes 152 of the conveyance guide 150, from the gap between the trailing end of the paper and the leading end of the subsequently conveyed paper. Therefore, even when the paper is heated and dried, problems such as wrinkling and denting are not liable to occur and the marks of the discharge holes are not liable to be left, thus making it possible to prevent contamination by water vapor inside the apparatus.

Moreover, by returning the heated air flow discharged from the conveyance guide 150 to the emission unit or using same for heat exchange in the heated air flow generating device, it is possible to improve thermal efficiency and to prevent contamination by water vapor inside the apparatus.

According to the composition described in FIG. 3, since the paper held by the grippers 91 and 92 of the transfer drum 84 is electrostatically attracted to the conveyance guide 150, the recording surface (the surface onto which the permeation suppression agent is deposited) does not make contact with the members of the transfer drum 84 and even if the recording medium is heated and dried, problems such as wrinkling or denting are not liable to occur and the marks of the discharge holes are not liable to be left in the medium.

Furthermore, in addition to a composition which discharges the heated air flow through the gap between sheets of paper on the conveyance guide 150, by also making the discharging width of the conveyance guide 150 broader than the width of the paper, it is possible to move the heated air flow swiftly in the breadthways direction and therefore the drying of the paper and the discharge and recovery of the drying air flow are further stabilized.

The gripper support sections 101 and 102 of the transfer drum 84 are provided with sensors 181 serving as devices for measuring the temperature and moisture content, such as infrared thermometers and infrared moisture meters, and the emission restricting member 116 is controlled in accordance with the measurement results of the sensors 181. For example, by measuring the change over time (and in particular, the start-up characteristics) of the temperature and moisture content at the same position in the vicinity of the leading end of the paper, by means of the sensors 181, and by controlling the emission restricting member 116 on the basis of the measurement results, it is possible to correct the emission range of the heated air flow in accordance with the paper being dried on the transfer drum 84, and therefore it is possible to carry out stable drying in accordance with the thickness and moisture absorption of the paper, and variation in the deposition volume of the permeation suppression agent and the deposition volume of the treatment liquid, which is described below.

The composition and the structure of the transfer drum 84 are described above with reference to FIG. 3 by way of example, and modification, addition and/or omission to the composition and the structure of the transfer drum 84 can be appropriately made.

Drying Operation in Transfer Drum

The drying operation in the transfer drum is hereby described more specifically.

Figure 4:
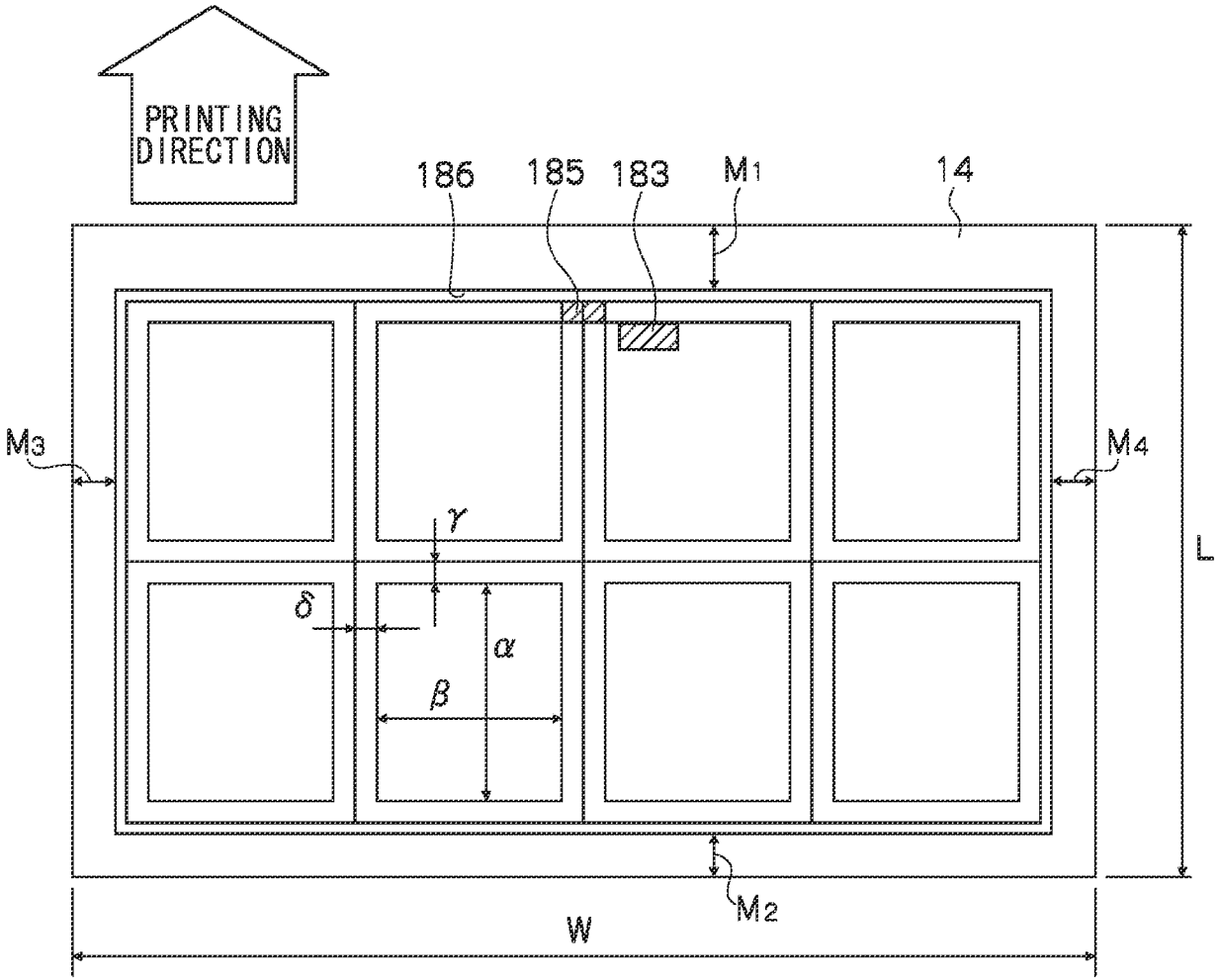
FIG. 4 is a diagram illustrating an example of a monitoring position of a sensor.

FIG. 4 is a diagram illustrating an example of a monitoring position 183 of the sensor 181 and a monitoring position 185 of a sensor unit 182 below described with reference to FIG. 10. Here, an example of multiple image (8-pages) imposition printing is described, but the invention is not limited to a multiple image printing mode, and it is also possible to carry out printing of one page onto one sheet of paper.

The upward direction in FIG. 4 is the printing direction (paper conveyance direction), and of the paper size L×W, a printable region 186 is formed to the inside of a leading end margin $M_1$ (including the portion which is held by the grippers 91 and 92), a trailing end margin $M_2$, a left-hand margin $M_3$ and a right-hand margin $M_4$. Permeation suppression agent is applied to the whole surface of the printable region 186. Image recording which ensures finished product dimensions $\alpha \times \beta$ and cutting margins $\gamma$, $\delta$ of a prescribed amount above, below and on the left-hand and right-hand sides of the image is carried out inside this printable region.

Since each sensor 181 is arranged in the same position on each of the grippers 91 and 92 of the transfer drum 84, it is possible to continuously measure the temperature of the recording medium 14 from the time that the recording medium 14 is transferred to the transfer drum 84 though the time that the recording medium 14 is transferred to the succeeding pressure drum. By recording the temporal change in the temperature, it is possible to obtain the data of the temporal change (the curve of the rise) in the surface temperature from the start of drying of the recording medium 14 by the transfer drum 84 and the conveyance guide 150.

Figure 5:
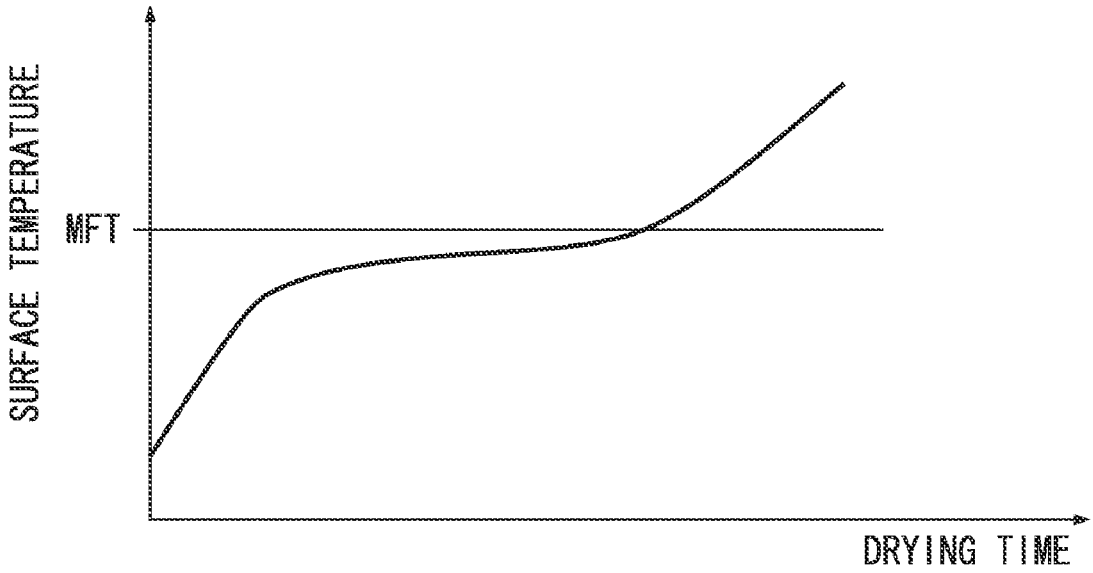
FIG. 5 is a graph illustrating temporal change in the surface temperature of the recording medium measured by the sensor.

FIG. 5 is a graph illustrating one example of the temporal change in the surface temperature thus obtained. The horizontal axis represents the drying time and the vertical axis represents the surface temperature. Furthermore, the "MFT" on the vertical axis indicates the minimum film forming temperature of the polymer that is added to the application liquid.

As illustrated in FIG. 5, the temperature rises sharply immediately after the start of measurement, due to heating by the conveyance guide 150 and heating by the drying air flow emitted from the transfer drum 84, and a layer of wet air is formed. Thereafter, as evaporation of water continues, the temperature reaches a certain balanced state, and when the solvent, such as water, decreases, the temperature rises again toward the right-hand side.

The deposition volume of the permeation suppression agent and the treatment liquid described below is equivalent to a liquid film thickness of 1 to 10 μm, and therefore temperature change occurs in a short period of time. By providing the radiation temperature sensor at the depicted position, it is possible to measure the temperature starting to rise quickly after the gripper 91 or 92 have held the paper, and the rotation of the emission restricting member 116 is controlled by observing the gradient of this temperature change.

By controlling the position of rotation of the emission restricting member 116 by measuring the temporal change (and desirably, the start-up characteristics) of the temperature and/or the solvent component, such as water, by means of the sensors 181, it is possible to correct the emission range of the heated air flow in respect of the paper that is being dried on the transfer drum 84. By this means, it is possible to achieve stable drying in respect of variation in the thickness and moisture absorption of the paper, and the deposition volumes of the permeation suppression agent and the treatment liquid described below.

Description of Treatment Liquid Deposition Unit 26

Next, the treatment liquid deposition unit 26 (see FIG. 1) which is disposed in a stage after the transfer drum 84 will be described.

The treatment liquid deposition unit 26 is provided with a treatment liquid head 202 and a treatment liquid drying unit 204 respectively at positions opposing the circumferential surface of the pressure drum (a treatment liquid deposition drum) 86, in this order from the upstream side in terms of the direction of rotation of the pressure drum 86 (the counter-clockwise direction in FIG. 1).

The treatment liquid head 202 ejects and deposits droplets of the treatment liquid onto the recording medium 14 which is held on the pressure drum 86 and adopts a composition similar to the ink heads 210Y, 210M, 210C and 210K disposed in the print unit 28, but it is also possible to adjust the shape and surface treatment of the nozzles, and the drive waveform, and the like, in accordance with the properties of the treatment liquid (aggregating treatment agent) such as the viscosity, the surface tension, the pH (hydrogen ion concentration), and so on.

Instead of the treatment liquid head 202, it is also possible to employ a similar composition to the permeation suppression processing unit 24 described with reference to FIG. 2. In the case where the similar composition to the permeation suppression processing unit 24 is adopted for the treatment liquid deposition unit 26, since the pressure drum 86, which holds and conveys the recording medium 14 in the treatment liquid deposition unit 26, has the gripper 87 for holding the leading end portion of the recording medium 14 (see FIG. 3), which is disposed with a step difference with respect to the outer circumferential surface, then the spiral roller 48 (see FIG. 2) is composed so as to avoid the step difference by being separated from the outer circumferential surface of the corresponding pressure drum in the portion of the gripper 87. The position of the gripper 87 and the roller separating structure shown in FIG. 3 are also employed in the other pressure drums 40, 306 and 326 (see FIG. 1), which convey the recording medium. On the other hand, in the case of the pressure drum 216 of the print unit 28 or the pressure drum 86 if an inkjet head is employed for the treatment liquid deposition unit 26, it is necessary for the heads 210K, 210C, 210M and 210Y to be situated in close proximity to the recording medium, and therefore a structure is employed in which the gripper 87 does not project beyond the outer circumferential surface.

The treatment liquid drying unit 204 employs a similar composition to the permeation suppression agent drying unit 46 of the permeation suppression processing unit 24 described above. A heater (not shown) of which the temperature is adjustable in the range of 50° C. to 130° C., and a fan (not shown) for blowing an air flow in the downstream direction at a rate of 5 m/s to 50 m/s are provided in the treatment liquid drying unit 204. When the recording medium 14 held on the pressure drum 86 of the treatment liquid deposition unit 26 passes downstream from a position opposing the treatment liquid drying unit 204, a warm air flow heated to 50° C. to 130° C. by means of the heater is directed by the fan onto the recording medium 14, thereby heating the recording medium 14, and pre-drying the treatment liquid.

The treatment liquid, such as aggregating treatment agent, used in the present embodiment is an acidic liquid which has the action of aggregating the coloring material contained in the inks which are deposited onto the recording medium 14 from the respective ink heads 210K, 210C, 210M and 210Y disposed in the print unit 28 at a downstream stage. More specifically, it may be one of the treatment liquids described Table 2 given below, or a treatment liquid having an added acid, such as 2-pyrrolidone-5-carboxylic acid, phosphoric acid, succinic acid, citric acid, or the like.

It is also possible to obviate the need for the permeation suppression layer by suppressing the permeation of the treatment liquid by adding a small amount of high-boiling-point solvent, such as glycerin, or polymer particles such as LX-1 described in Table 1, or the like. Consequently, by applying a treatment liquid having a permeation suppressing effect of this kind by means of the liquid application device 42, then the pressure drum 86, the treatment liquid head 202 and the treatment liquid drying unit 204, and the like, of the treatment liquid deposition unit 26 all become unnecessary.

The print unit 28 is provided after the treatment liquid deposition unit 26. A transfer drum 214 is provided between the pressure drum 86 of the treatment liquid deposition unit 26 and the pressure drum 216 of the print unit 28, so as to make contact with same. By this means, the treatment liquid is deposited onto the recording medium 14 held on the pressure drum 86 of the treatment liquid deposition unit 26, thereby forming a layer of aggregating treatment agent, whereupon the recording medium 14 is transferred through the transfer drum 214 to the pressure drum 216 of the print unit 28 by the grippers (not shown).

A conveyance guide 150 is provided at a position opposing the circumferential surface of the transfer drum 214, similarly to the transfer drum 84. While the print surface is conveyed in a non-contact fashion due to the heated air flow at a temperature of 50° C. to 130° C. which is blown out from the transfer drum 214 and the electrostatic attraction type of conveyance guide 150 which is adjusted to a temperature of 50° C. to 90° C., the print surface is heated and dried in a range of 40° C. to 60° C., and thereby a solid or semi-solid aggregating treatment agent layer (a thin film layer of dried treatment liquid) is formed on the recording medium 14. The "solid or semi-solid aggregating treatment agent layer" includes a layer having a water content rate of 0% to 70%, where the water content rate is defined as: "Water content rate"="Weight of water contained in treatment liquid after drying, per unit surface area ($g/m^2$)"/"Weight of treatment liquid after drying, per unit surface area ($g/m^2$)".

The composition of the transfer drum 214 is similar to that of the transfer drums 84 of the permeation suppression processing unit 24 described above, and therefore further description thereof is omitted here.

Description of Print Unit 28

The print unit 28 is provided with the ink heads 210K, 210C, 210M and 210Y, which respectively correspond to inks of four colors of black (K), cyan (C), magenta (M) and yellow (Y), at positions opposing the circumferential surface of the pressure drum (a print drum) 216, in this order from the upstream side in terms of the direction of rotation (the counter-clockwise direction in FIG. 1) of the pressure drum 216 which has been adjusted to a temperature of 30° C. to 50° C.

The ink heads 210K, 210C, 210M and 210Y employ recording heads of an inkjet type (inkjet heads). The ink heads 210K, 210C, 210M and 210Y eject liquid droplets of the respectively corresponding color inks toward the recording medium 14 which is held on the pressure drum 216 by vacuum attraction or electrostatic attraction.

Although the configuration with the KCMY four standard colors is described in the present embodiment, combinations of the ink colors and the number of colors are not limited to those. Light inks, dark inks or special color inks can be added as required. For example, a configuration is possible in which ink heads for ejecting light-colored inks such as light cyan and light magenta are added. Furthermore, there are no particular restrictions of the sequence in which the heads of respective colors are arranged.

Structure of Head

Next, the structure of each head will be described. The heads 210K, 210C, 210M and 210Y of the ink colors have the same structure, and a reference numeral 210 is hereinafter designated to any of the heads. A structure similar to the ink head 210 is also employed in the treatment liquid head 202 which is used in the treatment liquid deposition unit 26.

Figure 6A:
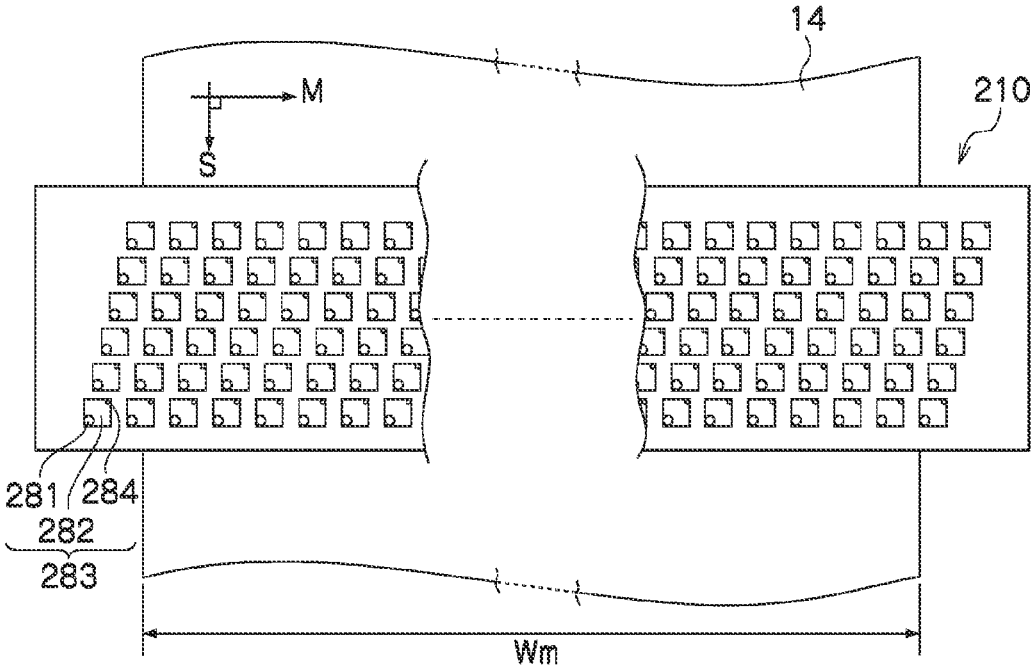
FIGS. 6A and 6B are plan view perspective diagrams illustrating the composition of an ink head.
Figure 6B:
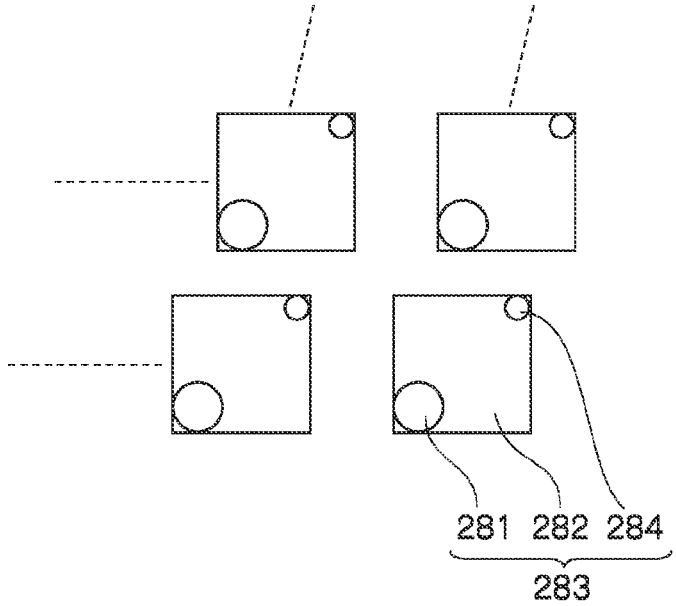

FIG. 6A is a perspective plan view illustrating an example of the configuration of the ink head 210, and FIG. 6B is an enlarged view of a portion thereof. The nozzle pitch in the ink head 210 should be minimized in order to maximize the density of the dots printed on the surface of the recording medium 14. As illustrated in FIGS. 6A and 6B, the ink head 210 according to the present embodiment has a structure in which a plurality of ink chamber units (droplet ejection elements) 283, each comprising a nozzle 281 forming an ink ejection port, a pressure chamber 282 corresponding to the nozzle 281, and the like, are disposed two-dimensionally in the form of a staggered matrix, and hence the effective nozzle interval (the projected nozzle pitch) as projected in the lengthwise direction of the head (the direction perpendicular to the paper conveyance direction) is reduced and high nozzle density is achieved.

Figure 7:
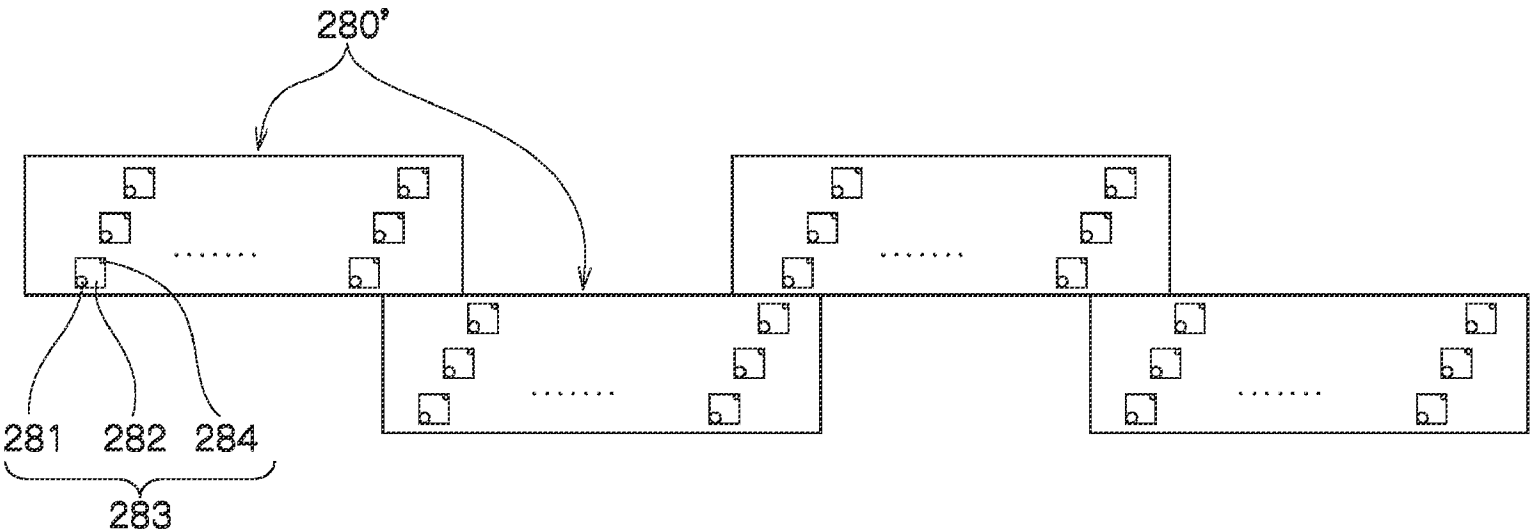
FIG. 7 is a plan diagram illustrating another composition of an ink head.

The mode of forming one or more nozzle rows through a length corresponding to the entire width of the image forming region in a direction (illustrated by an arrow M in FIG. 6A) substantially perpendicular to the conveyance direction of the recording medium 14 (illustrated by an arrow S in FIG. 6A) is not limited to the example illustrated in FIG. 6A. For example, instead of the configuration in FIG. 6A, as illustrated in FIG. 7, a line head having nozzle rows of a length corresponding to the entire width of the image forming region of the recording paper 14 can be formed by arranging and combining, in a staggered matrix, short head modules 280' having a plurality of nozzles 281 arrayed in a two-dimensional fashion, thereby making the whole length of the line head longer.

It is possible to eject ink droplets from the nozzles 281 by controlling the driving of each actuator (e.g., a piezoelectric actuator having a composition including upper and lower electrodes and a piezoelectric body placed between the upper and lower electrodes) arranged correspondingly to each of the nozzles 281, in accordance with the dot data generated from the input image by a digital half-toning process. By controlling the ink ejection timing of the nozzles 281 in accordance with the speed of conveyance of the recording medium 14, while conveying the recording paper in the sub-scanning direction at a uniform speed, it is possible to record a desired image on the recording medium 14.

Description of Solvent Drying Unit 30

Figure 8:
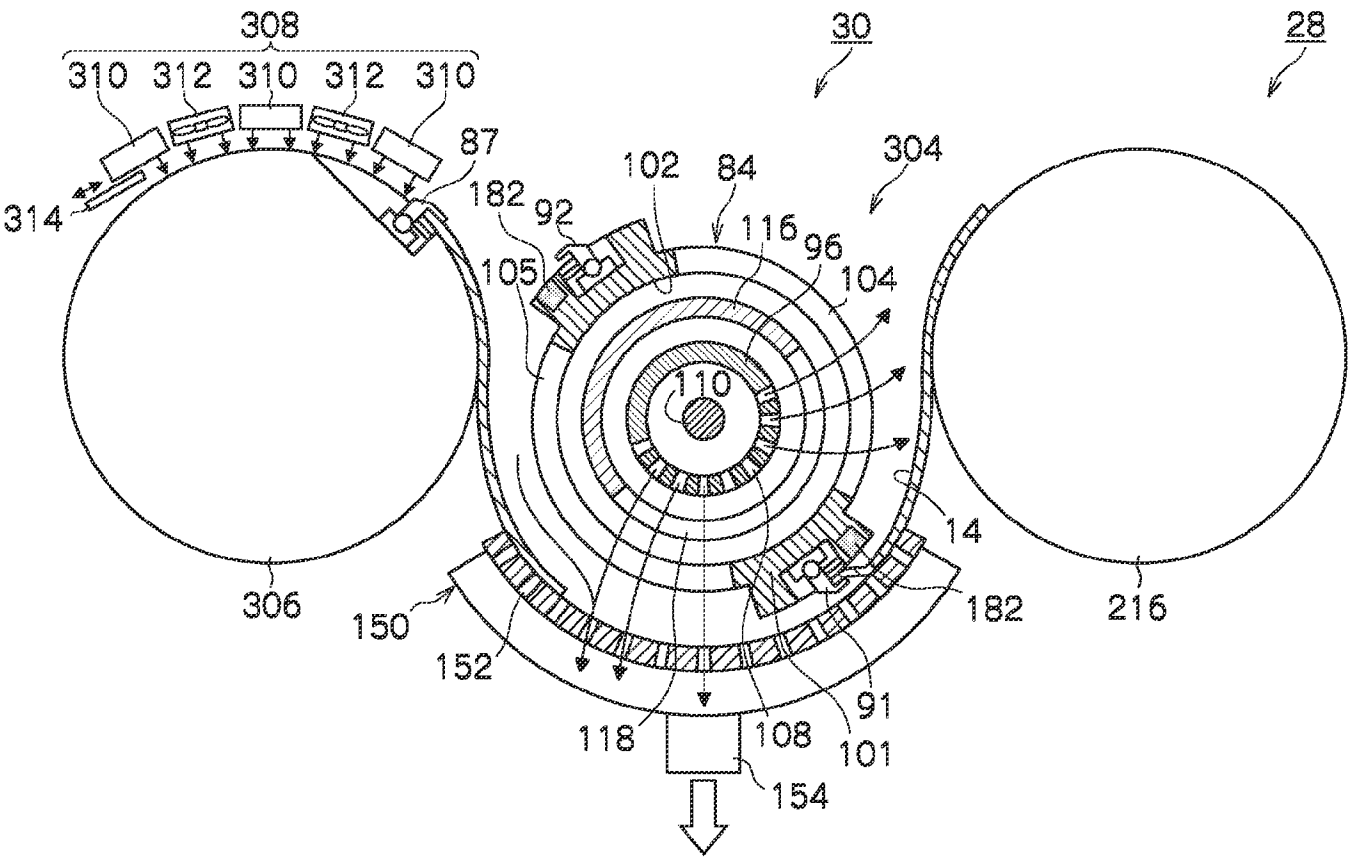
FIG. 8 is an enlarged diagram of a solvent drying unit in FIG. 1.

The solvent drying unit 30 is arranged following the print unit 28. FIG. 8 is a diagram illustrating an embodiment of the structure of the solvent drying unit 30.

As shown in FIG. 8, a transfer drum 304 is provided between the pressure drum 216 of the print unit 28 and the pressure dram (a drying treatment dram) 306 of the solvent drying unit 30 so as to lie in contact with both of these drums. By this means, after the respective color inks have been deposited on the recording medium 14 which is held on the pressure drum 216 of the print unit 28, the recording medium 14 is transferred via the transfer drum 304 to the pressure drum 306 of the solvent drying unit 30.

The composition of the transfer drum 304 is similar to that of the transfer drum 84 of the permeation suppression processing unit 24 described above. A conveyance guide 150 is provided at a position opposing the circumferential surface of the transfer drum 304, similarly to the transfer drums 84. While the printed surface is conveyed in a non-contact fashion due to the heated air flow at a temperature of 50° C. to 130° C. which is blown out from the transfer drum 304 and an electrostatic attraction type of conveyance guide 150 which is adjusted to a temperature of 50° C. to 90° C., the printed surface is heated in a range of 40° C. to 60° C., a layer of wet air is formed on the surface, and of the water contained in the ejected droplets of ink, the water mainly present on the surface is evaporated off.

Figure 9:
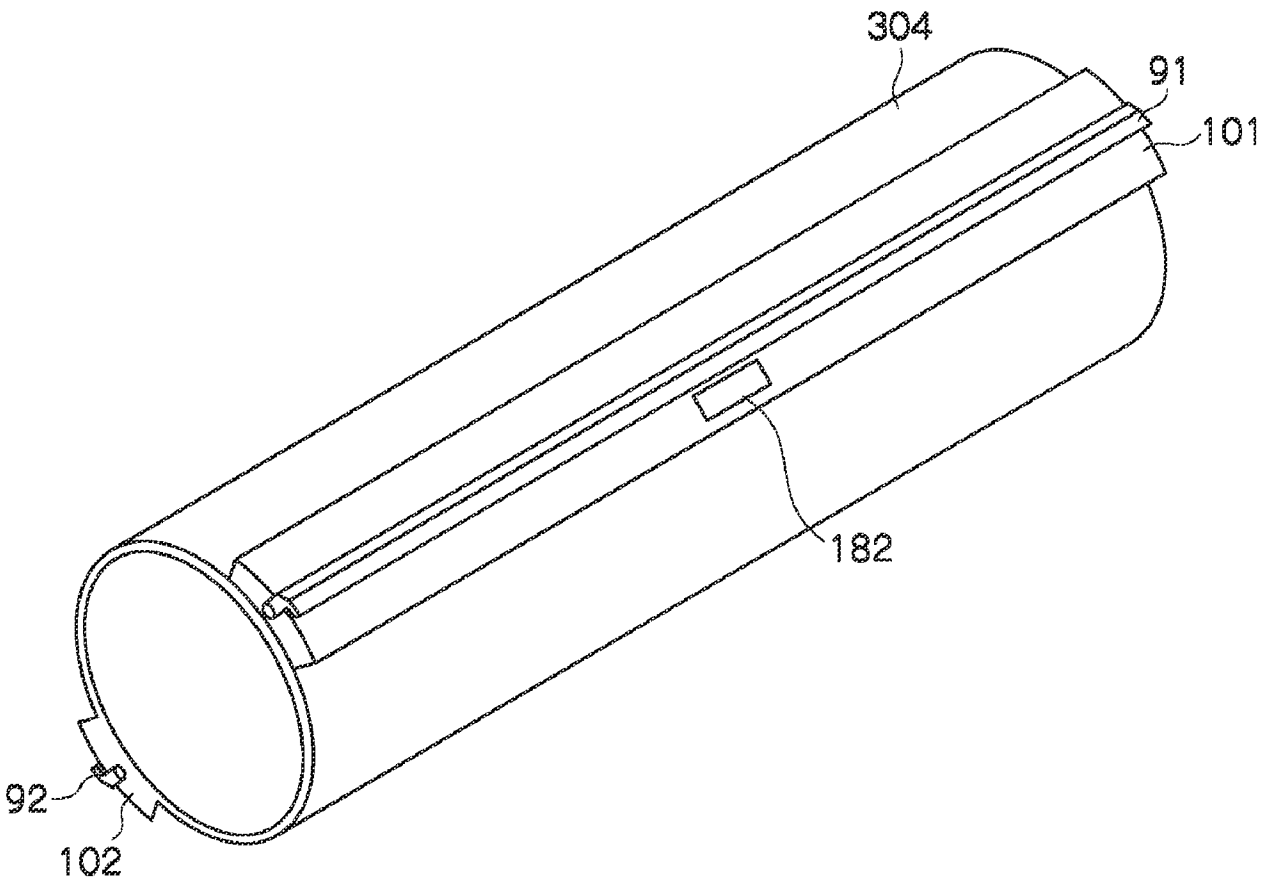
FIG. 9 is a schematic perspective diagram of a pressure drum in FIG. 1.

FIG. 9 is a schematic perspective diagram of the transfer drum 304 shown in FIG. 8. In FIG. 9, the conveyance guide 150 is not depicted.

As shown in FIG. 9, the sensor unit 182 is arranged in approximately the central portion in the axial direction of each of the gripper support sections 101 and 102, which are arranged through a length corresponding to the full width of the recording medium. The sensor unit 182 is disposed along the axial direction of the transfer drum 304. The position of the sensor unit 182 corresponds to the monitoring position 185, which is depicted by diagonal hatching in FIG. 4, and a patch formed at the monitoring position 185 shown in FIG. 4 can be determined continuously, during the time that the recording medium of which the leading end portion is held by the gripper 91 shown in FIG. 9 is being conveyed by the transfer drum 304, whereby determination information can be acquired during this time period.

More specifically, by reading in the optical density (here, the amount of reflected light) of the check pattern (the patch formed at the monitoring position 185 in FIG. 4) which has been printed on a non-image portion of the recording medium 14 by the sensor unit 182, and by correcting the ink ejection volume and/or the image data in accordance with the read results, it is possible to stabilize the image density even if there is change in the ink ejection volume and/or the treatment liquid deposition volume, etc., due to temperature increase inside the apparatus, or the like.

Further, it is also possible to correct the heating and drying conditions in real time by measuring the temperature and/or the moisture content in the monitoring position 185 in FIG. 4, in addition to the optical density of the check pattern printed on the non-image portion of the recording medium 14. By implementing control of this kind, the drying of the ink droplets deposited on the effective image region (reference numeral 186 in FIG. 4) and the drying of the droplets of ink deposited outside the image portion and the effective image region (for example, ink droplets ejected by purging from the inkjet heads 210K, 210C, 210M and 210Y) are also stabilized.

Furthermore, ink droplets are deposited onto portions of the recording medium 14 where the aggregating treatment agent has been applied (for example, the monitoring position 183 in FIG. 4) and has not been applied (for example, the monitoring position 185 in FIG. 4), and by using an in-line sensor 348 (see FIG. 1) to determine the degree of aggregation of the ink by measuring the optical densities of the check pattern thus formed in the region where aggregating treatment agent has not been applied, as well as the check pattern in the region where the aggregating treatment agent has been applied, and the blank medium surface, the speed of revolution and pressing force of the application roller are controlled accordingly, thereby controlling the deposition volume of the aggregating treatment agent.

If a check pattern is formed by separate dots in a pattern such as a staggered matrix, then apart from measuring the optical density, it is also possible to determine the degree of aggregation by measuring the dot diameters by using an imaging device, such as a CCD, for the in-line sensor, and in this case the aggregation can be determined with even greater accuracy.

Figure 10:
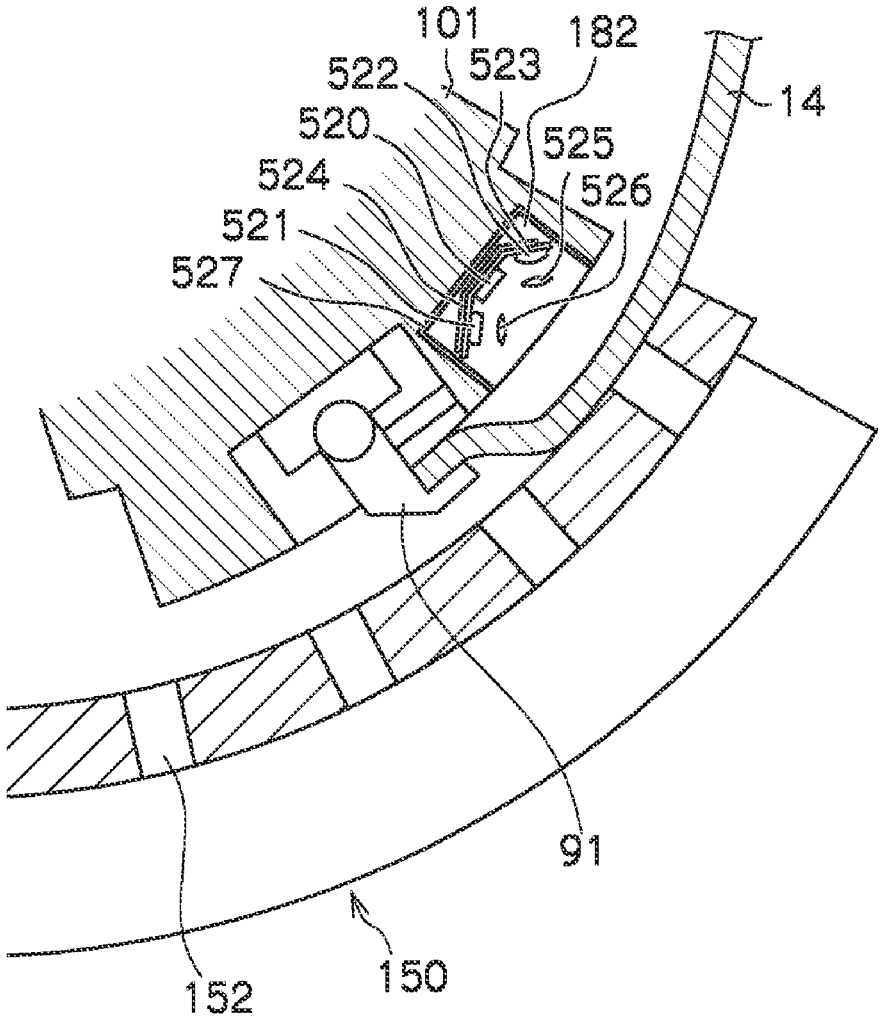
FIG. 10 is a partial enlarged view of FIG. 9.
Figure 11:
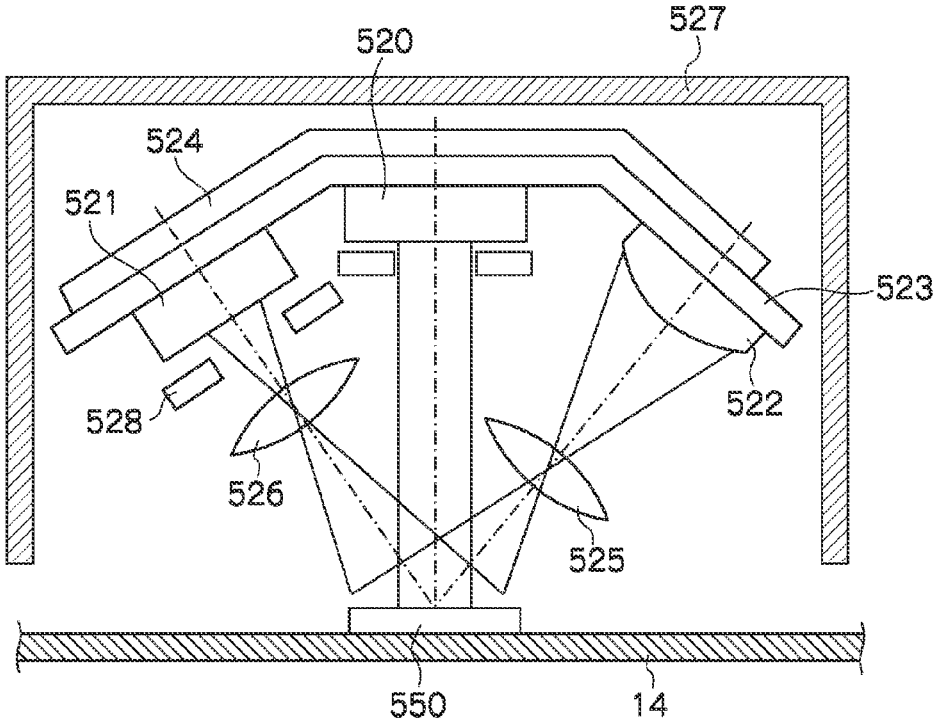
FIG. 11 is a diagram showing the composition of the sensor unit in FIG. 9.

FIG. 10 is a cross-sectional diagram showing an enlarged schematic view of the vicinity of the sensor unit 182 (in a state where the leading end portion of the recording medium 14 has arrived at the conveyance guide 150), and FIG. 11 shows an enlarged view of the sensor unit 182 only.

The sensor unit 182 shown in FIGS. 10 and 11 includes an infrared thermometer (infrared sensor) 520 and a density sensor (optical sensor) having a photoreceptor element 521 and a visible light source 522, and these elements are disposed on one surface of a substrate 523 (a surface opposing the recording medium 14).

Provided on the other surface of the substrate 523 are a signal processing unit for carrying out prescribed signal processing (noise removal processing, waveform shaping processing, amplification processing, and the like) on the determination signal obtained from the infrared sensor 520 and the optical sensor (photoreceptor element 521), and a stabilization circuit unit for supplying electric power, and the like.

Figure 17:
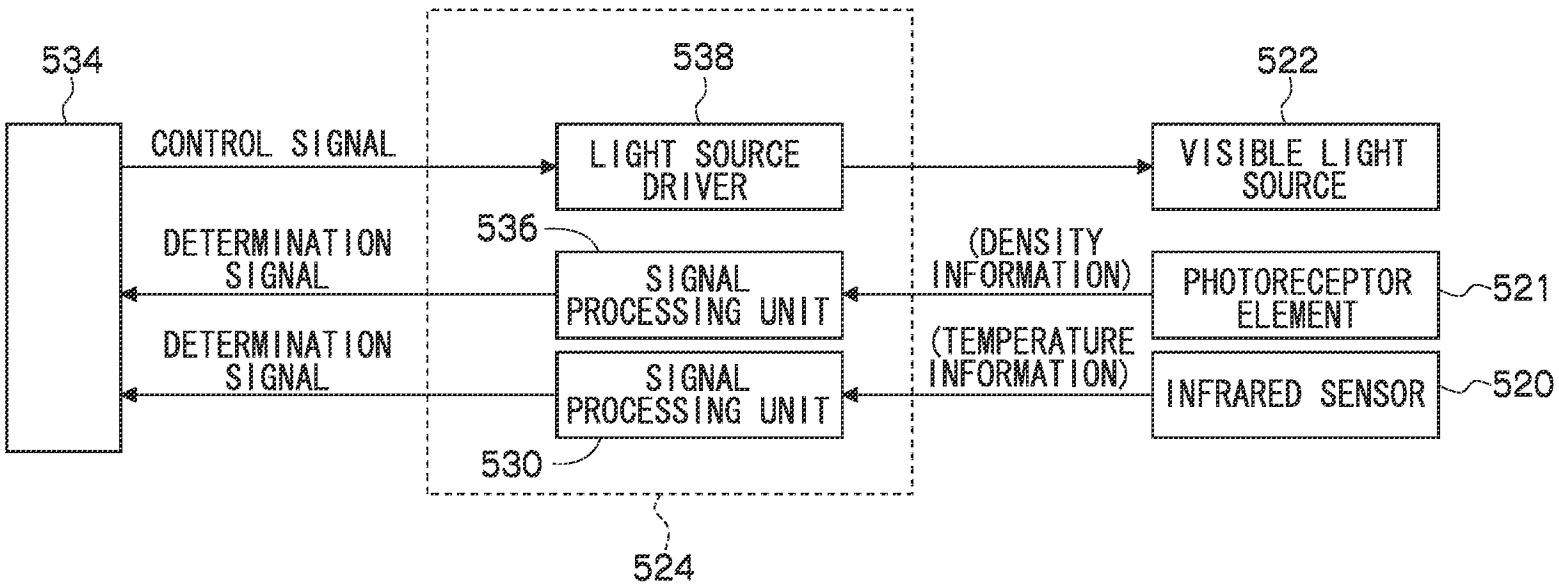
FIG. 17 is a block diagram showing the composition of the sensor unit in FIG. 10.

Wiring patterns for supplying electrical power and wiring patterns for transmitting signals are arranged on the substrate 523, and furthermore, connecting members (connectors, or the like, denoted with reference numeral 534 in FIG. 17) for making electrical connections with internal wiring patterns of the pressure drum 306 (wiring patterns arranged inside the pressure drum 306 which are electrically connected to the contact points of the connecting members 534 (not shown)) are also arranged. In FIGS. 10 and 11, the wiring patterns and the connecting members are denoted together with the reference numeral 524.

Moreover, a lens 525 is disposed in front of the incident surface (the surface opposing the recording medium 14) of the photoreceptor element 521 and a lens 526 is disposed in front of the irradiation surface (the surface opposing the recording medium 14) of the visible light source 522. The constituent members of the sensor unit 182 described above are accommodated inside a frame 527.

The infrared sensor 520 shown in FIGS. 10 and 11 determines the temperature at the monitoring position 185 on the recording medium 14 (see FIG. 4) and outputs a determination signal which is proportional to the determined temperature. By continuously storing data of this determination signal, it is possible to obtain information about the temperature change of the recording medium 14 with the passage of time (a temperature history or temperature gradient).

A desirable mode is one where the infrared irradiation position can be varied in accordance with the thickness of the recording medium 14 and the ink droplet ejection volume.

The optical sensor determines the optical density (reflective density) of a patch formed at the monitoring position 185 on the recording medium 14. A condensing lens 525 for concentrating the visible light on one point of the patch (for example, the central position of the patch 550 in FIG. 11) is disposed in front of the surface of the visible light source 522 included in the optical sensor from which the visible light is irradiated (i.e., between the visible light source 522 and the recording medium 14). A condensing lens 526 for gathering the visible light reflected by the recording medium 14 into the light receiving area of the photoreceptor element 521 and an aperture (limiting member) 528 for limiting the light receiving area of the photoreceptor element 521 are disposed in front of the surface of the photoreceptor element 521 for receiving the visible light (i.e., between the photoreceptor element 521 and the recording medium 14).

By means of the above-described composition, it is possible to obtain information about the optical density (reflective density) of the patch formed on the recording medium 14. Furthermore, since the photoreceptor element 521 and the visible light source 522 are moved in unison with the recording medium 14, then it is possible to determine the same determination position even if the recording medium 14 has moved, and therefore density determination abnormalities caused by insufficient light quantity of the visible light source 522 or insufficient sensitivity of the photoreceptor element 521 can be avoided. Moreover, even if the recording medium 14 is conveyed at the highest speed, it is possible to ensure a determination time of 0.3 seconds to 3 seconds approximately, and hence the photoreceptor element 521 does not need to have a high sensitivity, but rather a generic photoreceptor element can be used. Similarly, the visible light source 522 does not need to have a high output, but rather a generic light source can be used.

In the patch determination described in the present embodiment, it is possible to carry out temperature determination based on infrared energy and optical density determination based on visible light, with respect to the same determination position. In other words, even if visible light from the visible light source 522 is irradiated onto the same determination position within the patch 550, since there is no mutual interference between the infrared energy which is measured and the visible light which is irradiated, then it is possible to acquire temperature information and optical density information simultaneously at the same determination position.

More specifically, desirably, the wavelength range of the visible light irradiated is set to 360 nm to 960 nm, and the wavelength range of the infrared energy determined is set to 0.78 μm to 15 μm. It is particularly desirable that the wavelength range of the visible light irradiated is set to 400 nm to 700 nm, which is the range of the absorption wavelengths of ink, and the wavelength range of the infrared energy determined is set to 8 μm to 14 μm, which is the range of the infrared wavelengths little affected by the air.

The present embodiment describes the mode in which temperature determination by infrared energy and optical density determination by visible light are carried out simultaneously at the same determination position, but the scope of application of the present invention is not limited to using a combination of infrared energy and visible light. More specifically, the present invention can be applied widely to a mode which uses light of two different types having wavelength ranges which do not interfere mutually.

Moreover, FIGS. 10 and 11 show the mode in which the photoreceptor element 521, the infrared sensor 520 and the visible light source 522 are arranged in sequence from the downstream side in terms of the conveyance direction of the recording medium 14, but the photoreceptor element 521, the infrared sensor 520 and the visible light source 522 may also be arranged in the breadthways direction of the recording medium 14, which is perpendicular to the conveyance direction of the recording medium 14, or in a direction which is oblique with respect to the conveyance direction of the recording medium 14, and the order of their arrangement may be changed suitably.

Furthermore, instead of or in conjunction with the mode where the temperature of the recording medium 14 is determined by the infrared sensor 520, it is also desirable that the moisture content on the recording medium 14 is determined using an infrared moisture meter, or the like. By monitoring the moisture content on the recording medium 14, it is possible to measure the increase in the moisture content (amount of evaporation) and therefore highly responsive drying control becomes possible.

FIG. 9 shows the mode where the sensor unit 182 is disposed substantially in the central portion in the axial direction of the transfer drum 304; however, it is also desirable that a plurality of sensor units 182 are arranged at a prescribed arrangement pitch following the axial direction of the transfer drum 304.

In a case where a plurality of patches are formed following the breadthways direction of the recording medium 14, at positions corresponding to the positions of the plurality of sensor units 182, and the respective patches are determined by the corresponding sensor units 182, it is possible to obtain a temperature distribution and a density distribution in the breadthways direction of the recording medium 14, from the determination signals.

Instead of a composition which includes a plurality of sensor units 182 at a prescribed arrangement pitch following the axial direction of the transfer drum 304, it is possible to obtain similar beneficial effects if one sensor unit 182 is moved to scan the recording medium 14 through the entire width of the recording medium 14 following the axial direction of the transfer drum 304.

The solvent drying unit 308 is disposed so as to oppose the circumferential surface of the pressure drum 306 to which the recording medium 14 is transferred from the transfer drum 304. It is also possible to use an infrared irradiation device or a heated air flow blowing device in the solvent drying unit 308. By irradiation of infrared energy or blowing a heated air flow by means of the solvent drying unit 308, the printed surface of the recording medium 14 on the pressure drum 306 is heated to 40° C. to 80° C., thereby sufficiently removing the water content, and lowering the viscosity of the high-boiling-point solvent, such as glycerin or diethylene glycol, which is contained in the ink for the purpose of preventing drying and adjusting the viscosity. Furthermore, by heating the polymer particles contained in the ink, it is also possible to improve the fixing properties. Voids are gradually formed in the permeation suppression layer that has been deposited on the permeation suppression treatment unit 24 by the action of the treatment liquid deposited by the treatment liquid deposition unit 26, thereby allowing the high-boiling-point solvent to permeate into the recording medium 14 as well.

FIG. 8 shows a mode where infrared heaters 310 and ventilator fans 312 are disposed alternately along the outer circumferential surface of the pressure drum 306, as an example of the composition of the solvent drying unit 308. As shown in FIG. 8, a desirable mode is one where a heating control member (shutter) 314 is arranged between the ventilator fan 312 and the outer circumferential surface of the pressure drum 306, and the volume of the air flow emitted by the ventilator fan 312 is controlled.

The heating control member 314 shown in FIG. 8 is composed so as be slidable between the ventilator fan 312 and the outer circumferential surface of the pressure drum 306, and by covering a portion of the region of blowing of the ventilator fan 312, it is possible to reduce the volume of the air flow that is directed onto the recording medium. In FIG. 8, the heating control member 314 is arranged only for the ventilator fan 312 on the furthest downstream side in the direction of conveyance of the recording medium 14, but it is of course also possible to provide another heating control member 314 for the other ventilator fan 312.

The infrared heater 310 is composed in such a manner that the amount of heat radiated thereby can be varied, and when the target surface temperature of the recording medium 14 has been set, the amount of heat radiated by the infrared heater 310 (or the on/off switching of the infrared heater 310) is controlled in accordance with the set target temperature.

The solvent drying unit 308 in the present embodiment controls the amount of heat radiated in accordance with the previously established surface temperature of the recording medium, by suitably controlling the amount of heat radiated by the infrared heater 310 and the air flow volume of the ventilator fan 312. It is also desirable that the solvent drying unit 308 controls the amount of heat radiated by the infrared heater 310 and the volume of the air flow emitted by the ventilator fan 312, on the basis of the temperature information obtained from the sensor units 182 arranged on the transfer drum 304.

Each of the sensor units 182 arranged in the gripper support sections 101 and 102 of the transfer drum 304 has the infrared sensor 520 (not shown in FIG. 8, and shown in FIGS. 10 and 11) which determines the temperature of the liquid, such as ink, applied to the recording medium and the reflective optical sensor (not shown in FIG. 8; constituted of the photoreceptor element 521 and the visible light source 522 in FIGS. 10 and 11) which determines the reflective optical density of the liquid applied to the recording medium 14, and the emission restricting member 116 is controlled in accordance with the temperature determination result (or the moisture content determination result) of the sensor unit 182, in addition to which the droplet ejection of the print unit 28 is controlled in accordance with the determination results of the optical density of the ink.

For example, by measuring the change over time (and in particular, the start-up characteristics) of the temperature and/or water content at the same position in the vicinity of the leading end of the recording medium 14, by means of the sensor unit 182, and by controlling the emission restricting member 116 on the basis of the measurement results, it is possible to correct the emission range of the heated air flow in accordance with the recording medium 14 being dried on the transfer drum 304, and therefore it is possible to carry out stable drying in accordance with the thickness and moisture absorption of the recording medium 14, and the variation in the deposition volume of the permeation suppression agent and the deposition volume of the treatment liquid.

The composition of the transfer drum 304 positioned on the downstream side of the print unit 28 in terms of the conveyance direction of the recording medium is also employed for the transfer drums 325 and 344. Here, the determination position of the sensor unit in each of the transfer drums 325 and 344 is the monitoring position 183 shown in FIG. 4.

Description of Heat and Pressure Fixing Unit 32

The heat and pressure fixing unit 32 is provided after the solvent drying unit 30. A transfer drum 324 is provided between the pressure drum 306 of the solvent drying unit 30 and a pressure drum (a heat and pressure fixing treatment drum) 326 of the heat and pressure fixing unit 32, so as to make contact with same. By this means, the water content of the inks of respective colors is removed from the recording medium 14 held on the pressure drum 306 to of the solvent drying unit 30, and the viscosity of the high-boiling-point solvent is lowered so that the high-boiling-point solvent permeates into the recording medium 14, whereupon the recording medium 14 is transferred through the transfer drum 324 to the pressure drum 326 of the heat and pressure fixing unit 32.

Figure 12B:
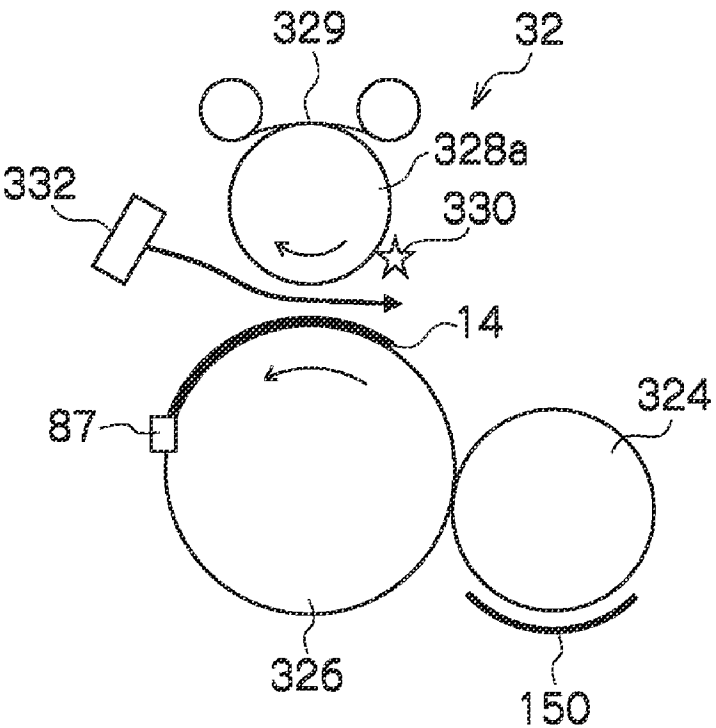
FIGS. 12A and 12B are diagrams showing the composition of a heat and pressure fixing unit in FIG. 1.
Figure 12A:
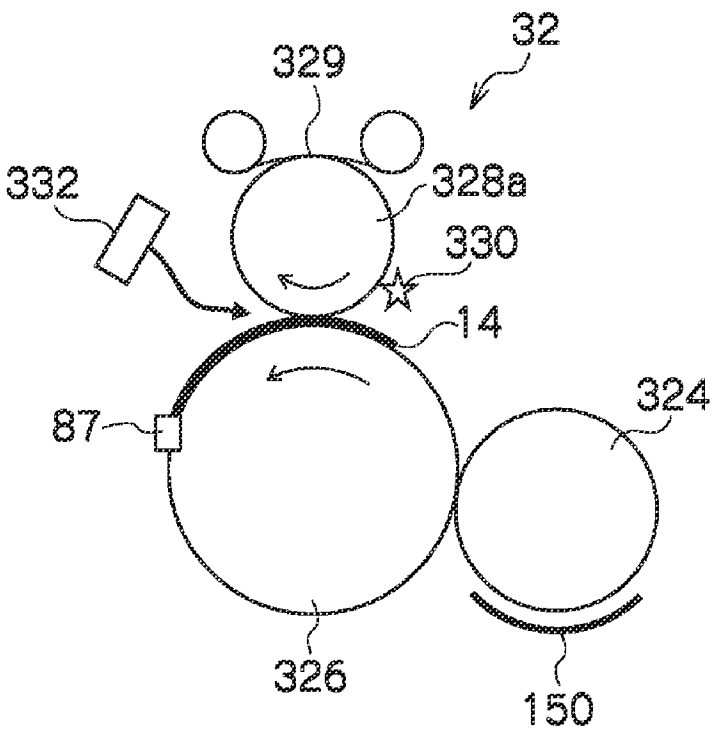

FIG. 12A is an approximate schematic drawing showing a schematic view of the composition of the heat and pressure fixing unit 32 (first example). As shown in FIG. 12A, the heat and pressure fixing unit 32 is provided with a heat roller (fixing roller) 328*a*, which is settable to a temperature of 60° C. to 180° C., to oppose the pressure drum 326, which is adjusted to a temperature of 40° C. to 80° C. Desirably, the heat roller 328 is formed by coating (or covering) the surface of rubber with a liquid-repellant material, such as PFA or fluoro elastomer, or the like, or applying a hard chrome plating to a rigid member.

Furthermore, by making the heat roller 328*a* longer in the lengthwise direction than the maximum width of the recording medium 14, and pressing both end portions of the heat roller 328*a* directly against the pressure drum 326, the heat roller 328*a* also receives a driving force from the pressure drum 326 when pressing against the recording medium 14, and therefore distortion of the recording surface of the recording medium 14 and roller offset are alleviated. The drive force can be increased by disposing a member having a high coefficient of friction, such as rubber, on either end portion of the heat roller 328*a*, or carrying out a surface roughening process, or the like.

A cleaning unit 329 which has the function of applying a separating agent is abutted against the heat roller 328*a*. For the separating agent, apart from silicon oil, which is generally used for separation purposes, it is also possible to use a high-boiling-point solvent which is permeable into the paper, and from the viewpoint of separating properties and glossiness, it is desirable to apply the separating agent to a thickness of 30 nm to 1 μm.

The structure of the transfer drum 324 is the same as that of the transfer drums 84, 214 and 304, which have been described above, and therefore detailed description thereof is omitted here. A warm air flow at 50° C. to 70° C. is blown from the transfer drum 324 while monitoring the temperature of the recording medium 14 which has been subjected to the heating and drying process by the pressure drum 306 of the solvent drying unit 30, and furthermore, the recording medium 14 is electrostatically attracted to the conveyance guide 150 which is adjusted to a temperature of 50° C. to 70° C., thereby adjusting to a suitable temperature in accordance with the type (the surface type, thickness, and so on) of the recording medium 14. By means of this composition, the temperature distribution on the printing surface of the recording medium 14 which is conveyed in a non-contact fashion is stabilized, and the film formation of the polymer particles is also stabilized.

Thereafter, the recording medium 14 that is transferred to the pressure drum 326 heated by the heating device (not shown) is applied with heat and pressure by means of the heat roller 328*a*, then the polymer particles contained in the ink are formed sufficiently into a film, thereby making the image permanent and fixing same to the recording medium 14.

The heat and pressure fixing process described in the present embodiment (gloss fixing process) controls the pressing and separation of the heat roller 328*a* in accordance with the type of recording medium 14, and switches between applying and not applying pressure during the heat and pressure fixing process, in accordance with the type of recording medium 14. In other words, a movement mechanism (not shown) which moves the heat roller 328*a* in the upward/downward direction is provided, in such a manner that the heat roller 328*a* can be switched between pressing and separation by operating the upward/downward mechanism in accordance with the type of recording medium 14.

FIG. 12A is a diagram showing a schematic view of a state where the heat roller 328*a* has been pressed against the printing surface of the recording medium 14 (a case of a pressurized process), and FIG. 12B is a diagram showing a schematic view of a state where the heat roller 328*a* is separated from the printing surface of the recording medium 14 (a case of a non-pressurized process). The member indicated by the reference numeral 330 in FIGS. 12A and 12B is a star wheel for suppressing floating up of the trailing edge portion of the recording medium 14, and this member moves in the up/down direction in unison with the heat roller 328*a*.

A fan 332 for blowing air toward the recording medium 14 is provided on the downstream side of the heat roller 328*a* in terms of the medium conveyance direction. If the heat roller 328*a* presses the recording medium 14, then the air which is blown constantly from the fan 332 is supplied to the contact portion between the heat roller 328*a* and the recording medium 14, as indicated by the arrowed line in FIG. 12A. On the other hand, if the heat roller 328*a* is separated from the recording medium 14, then the air which is blown from the fan 332 forms an air flow which passes between the heat roller 328*a* and the recording medium 14 and exits to the upstream side of the heat roller 328*a* in terms of the medium conveyance direction as shown by the arrowed line in FIG. 12B.

In the heat and pressure fixing process described in the present embodiment, if a recording medium 14, such as matt-coated paper, which is subjected to a heat fixing process by applying heat without applying pressure is used, then the temperature of the heat roller 328*a* is set to 100° C. to 150° C., the heat roller 328*a* is separated from the recording medium 14, and the heat roller 328*a* is thus set to a temperature some 60° C. to 100° C. higher than the temperature in a case where the heat roller 328*a* is pressed against the recording medium 14.

By means of this control, it is possible to reduce the damage to the surface of low-gloss paper, such as matt-coated paper, while stabilizing the glossiness of the paper. Furthermore, by setting the temperature of the heat roller 328*a* to be higher than when the heat roller 328*a* is pressed against the recording medium 14, the evaporation of the water content in the ink progresses suitably even though the heat roller 328*a* is separated, and it is possible to form a film by heating the polymer particles contained in the ink to the minimum film forming temperature (MFT) or above, thus ensuring drying and fixing properties. Moreover, if a recording medium having a weak coating strength (for example, matt-coated paper or fine-coated paper), or a non-coated paper, is used, or if an ink drying error has occurred, or the like, then it is possible to prevent adherence of the ink to the heat roller 328*a*, and the drying and fixing of the ink can be further promoted by the heating by the air flow emitted from the fan 332.

The air emitted from the fan 332 is desirably heated, for instance, inside the pressure drum (the heating and fixing process drum) 326, and air having a temperature of 40° C. to 80° C. is emitted at a rate of 200 mm/s to 100 mm/s. Moreover, by setting the temperature of the heat roller 328*a* to 150° C. to 180° C., and heating the polymer particles to the glass transition point or above, the film formation of the polymer particle is stabilized and drying and fixing properties are further improved. The temperature of the air emitted from the fan 332 can be set even higher.

Figure 13:
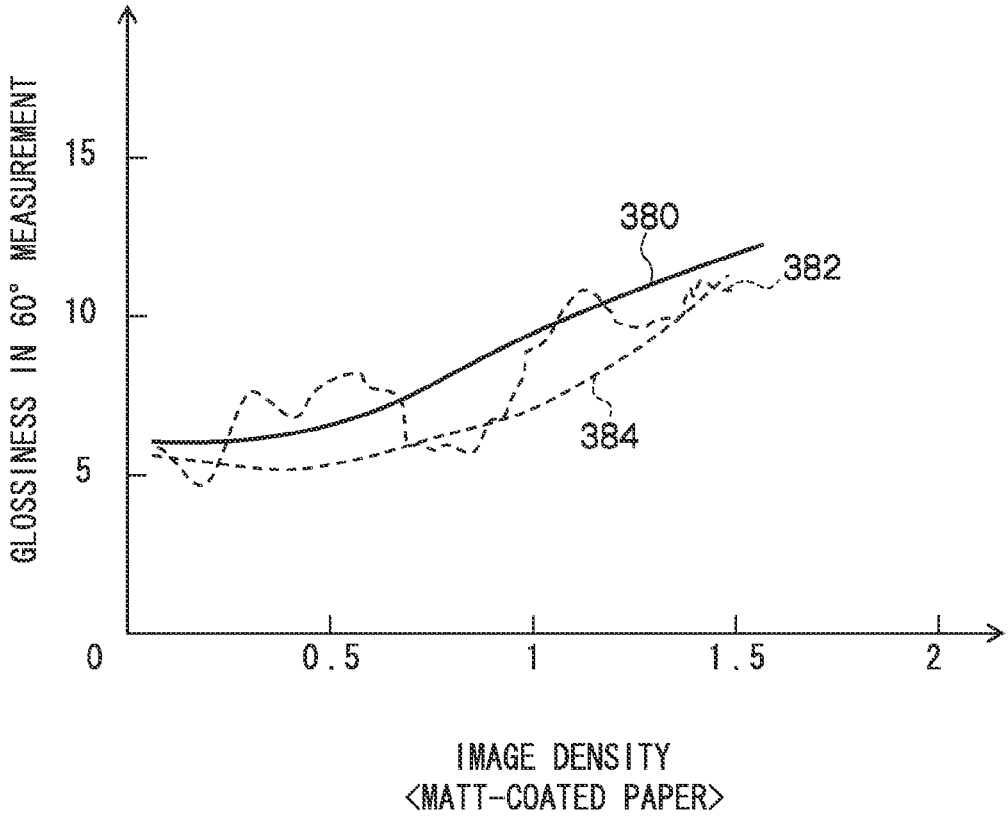
FIG. 13 is a diagram illustrating the beneficial effects of a heat and pressure fixing process by means of a non-pressing process in the present embodiment.
Figure 18A:
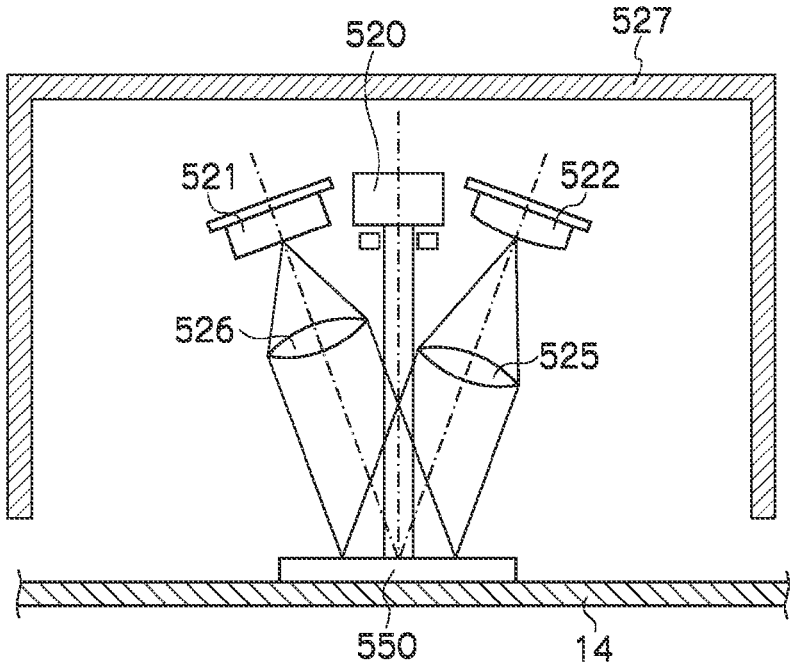
FIGS. 18A and 18B are diagrams showing the composition of the sensor unit according to a modified embodiment.
Figure 18B:
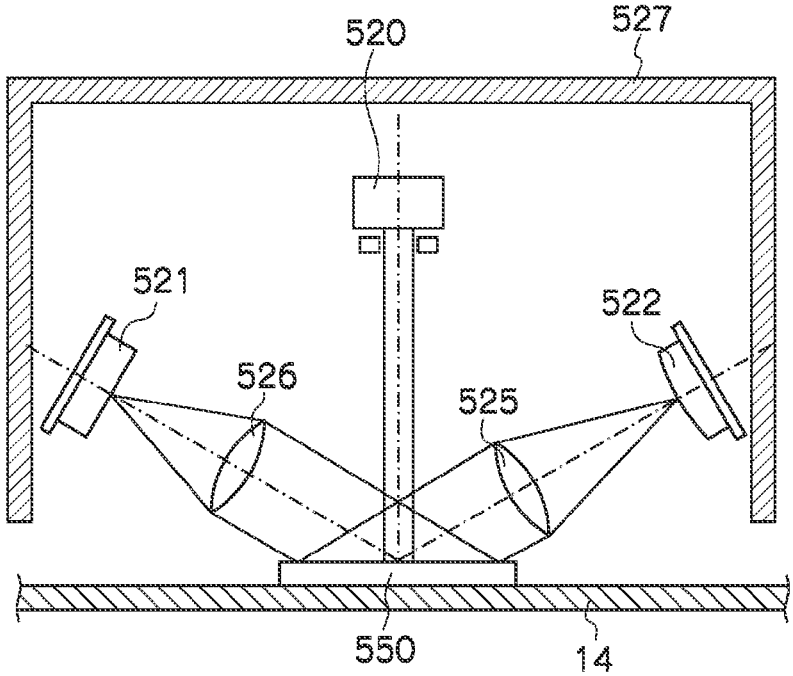

FIG. 13 is a diagram showing the beneficial effects of the heat and pressure fixing process described in the present embodiment, and depicts the relationship between the image density and the glossiness (when the angle between the normal of the object and the normal of the measurement plane is 60°; see FIG. 18B). The curve indicated by the solid line and denoted with the reference numeral 380 in FIG. 13 represents the glossiness with respect to image density in a case where a matt-coated paper is used, the heat roller 328*a* is separated during the heat and pressure fixing process, and the set temperature is raised compared to to when the heat roller 328*a* is pressed.

If a recording medium having coarse surface properties, such as a matt-coated paper, is used, then roller offset is suppressed by the separation of the heat roller 328*a* during the heat and pressure fixing process, and stable glossiness can be obtained, and by also raising the set temperature, the polymer particles added to the ink form a film and the ink fixing properties are raised.

On the other hand, the curve indicated by the broken line denoted with reference numeral 382 relates to a case where the heat roller 328*a* is pressed and the glossiness becomes instable, due to roller offset. Furthermore, the curve indicated by the broken line denoted with reference numeral 384 relates to a case where the heat roller 328*a* is separated and a heat and pressure fixing process is carried at the same temperature setting as when the heat roller 328*a* is pressed against the recording medium. By means of this heat and pressure fixing process, although the glossiness is stable, the glossiness is lower compared to a case where the set temperature is raised, and peeling and/or abrasion of the image portion is liable to occur due to insufficient fixing of the ink.

Figure 14:
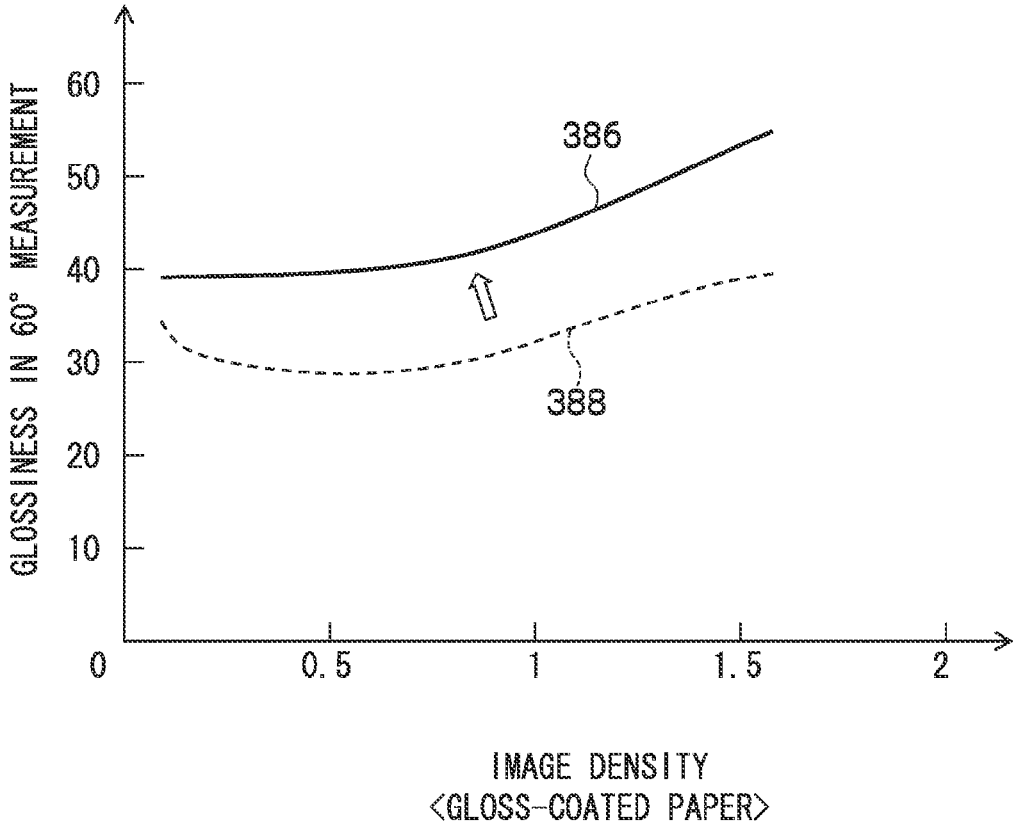
FIG. 14 is a diagram illustrating the beneficial effects of a heat and pressure fixing process by means of a pressing process in the present embodiment.

FIG. 14 shows the relationship between the image density and the glossiness (when the angle between the normal of the object and the normal of the measurement plane is 60°; see FIG. 18B), in a case where a gloss-coated paper is used. If a recording medium having high surface smoothness, such as gloss-coated paper is used, then as shown by the curve denoted with reference numeral 386 in FIG. 14, by pressing the heat roller 328*a* during the heat and pressure fixing process, it is possible to obtain stable and high (desired) glossiness in respect of the image density.

On the other hand, if the heat roller 328*a* is separated during the heat and pressure fixing process, then as indicated by the curve denoted with reference numeral 388 in FIG. 14, the glossiness is insufficient and it is difficult to guarantee quality in a photographic image, or the like.

Figure 15:
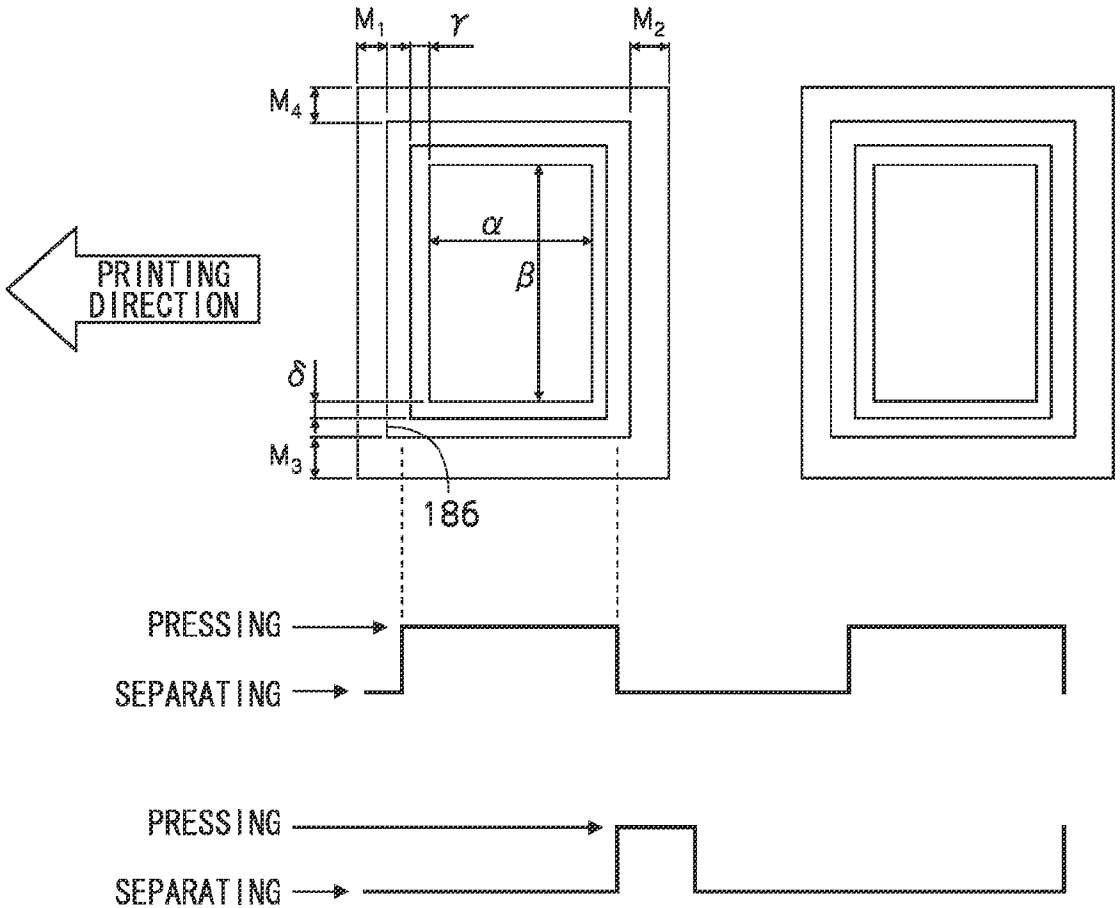
FIG. 15 is an illustrative diagram of pressing and separation control of the heat roller in FIGS. 12A and 12B.

FIG. 15 is a diagram for describing the pressing position (pressing timing) and separating position (separation timing) of the heat roller 328*a*, on the recording medium 14.

In the portion (a) of FIG. 15, the direction indicated by the outlined arrow is the conveyance direction of the recording medium (printing direction), and the recording medium 14 is conveyed from right to left. FIG. 15 shows a case where one image is recorded on one sheet of recording medium 14. Furthermore, the references $M_1$ to $M_4$ and $\alpha$ to $\delta$ in FIG. 15 are common with those in FIG. 4 and further description thereof is omitted here.

The portion (b) of FIG. 15 shows the control of the heat roller 328*a* in a case where a heat and pressure fixing process is carried out by applying pressure, and the portion (c) of FIG. 15 shows the control of the heat roller 328*a* in a case where a heat and pressure fixing process is carried out without applying pressure. In FIG. 15, the time period indicated by "pressed" means the pressing time period during which the heat roller 328*a* is pressed against the recording medium 14, and the time period indicated by "separated" means the separation time period during which the heat roller 328*a* is separated from the recording medium 14.

In a case where the heat and pressure fixing process is carried out by applying pressure as shown in the portion (b) of FIG. 15, the heat roller 328*a* is pressed at a position forward of the cutting margin of the recording medium 14 (a position on the downstream side in terms of the medium conveyance direction). In other words, the pressing position (pressing timing) is determined in such a manner that the heat roller 328*a* does not make contact with the image portion where the image is formed. Desirably, the heat roller 328*a* is pressed at a position to the downstream side of the portion where the treatment liquid is applied, in terms of the medium conveyance direction.

By means of this control of the pressing of the heat roller 328*a*, the occurrence of "landing" offset when the heat roller 328*a* makes contact with the recording medium 14 is reduced.

On the other hand, the heat roller 328*a* is separated from the recording medium 14 immediately after the cutting margin has passed below the heat roller 328*a*. By separating the heat roller 328*a*, any distortion in the recording medium 14 caused by the pressing of the heat roller 328*a* is released, and furthermore, air is allowed to escape.

In a case where the heat and pressure fixing process is carried out without applying pressure as shown in the portion (c) of FIG. 15, the heat roller 328*a* is pressed in a position immediately after the cutting margin (a position on the upstream side in terms of the medium conveyance direction), and the heat roller 328*a* is separated so as to avoid interference with the gripper 87 (see FIGS. 12A and 12B). By means of this control of the pressing of the heat roller 328*a*, the air flow emitted from the fan 332 is not emitted locally onto the heat roller 328*a*, due to intermittent rotation of the heat roller 328*a*, and therefore local heating of the heat roller 328*a* is suppressed, and furthermore, improved efficiency of use of the heat generated from the heat roller 328*a* can be expected. Moreover, by causing the heat roller 328*a* to land on the trailing end portion of the recording medium 14, floating up of the trailing end portion of the recording medium 14 is suppressed.

Description of Output Unit 34

The output unit 34 is provided after the heat and pressure fixing unit 32. A transfer drum 344 is provided between the pressure drum 326 of the heat and pressure fixing unit 32 and an output tray 346 of the output unit 34 so as to lie in contact with both. By this means, the image on the recording medium 14 held on the pressure drum 326 of the heat and pressure fixing unit 32 is made permanent by the heat and pressure fixing unit 32, and the recording medium 14 is then transferred to the output tray 34 via the transfer drum 344 and output to the exterior of the machine.

The transfer drum 344 has the same structure as the transfer drums 84, 214, 304 and 324 described above, and by blowing a heated air flow emitted from the transfer drum 344 (see FIG. 3), or by applying heat from the conveyance guide 150 having an electrostatic attraction system, drying of the high-boiling-point organic solvent on the recording medium 14 is promoted and curling of the recording medium 14 is corrected.

The temperature and the reflective density of the recording medium 14 after the passage through the pressure drum 326 are determined using the sensor units 182 (see FIG. 9) which are provided in the gripper support sections 101 and 102. By comparing these determination results and the temperature and the reflective density of the recording medium 14 before passage through the pressure drum 326, which are determined by means of the sensor unit 182 on the transfer drum 304, it is possible to achieve further stabilization of the glossiness and the roller offset, and the like, in respect of change in the temperature and/or the humidity during operation.

Moreover, by combining information about the type of the recording medium 14 and the temperature adjustment of the heat roller 328*a*, it is possible to achieve more precise fixing control (drying control, and heat and pressure fixing control).

The output unit 34 is provided with an in-line sensor 348 including an imaging element such as a CCD to measure the check pattern of the recording medium 14. As stated previously, it is possible to maintain stable quality by means of the in-line sensor 348 in relation to magnification rate, image distortion and positional deviation, by measuring the optical density and dot diameter of the patch and controlling the amount of aggregating treatment agent applied, by measuring patterns of various colors and correcting the color tones, and by measuring the pattern at the leading and trailing ends and in the breadthways direction and correcting the rate of magnification.

Description of Control System

Figure 16:
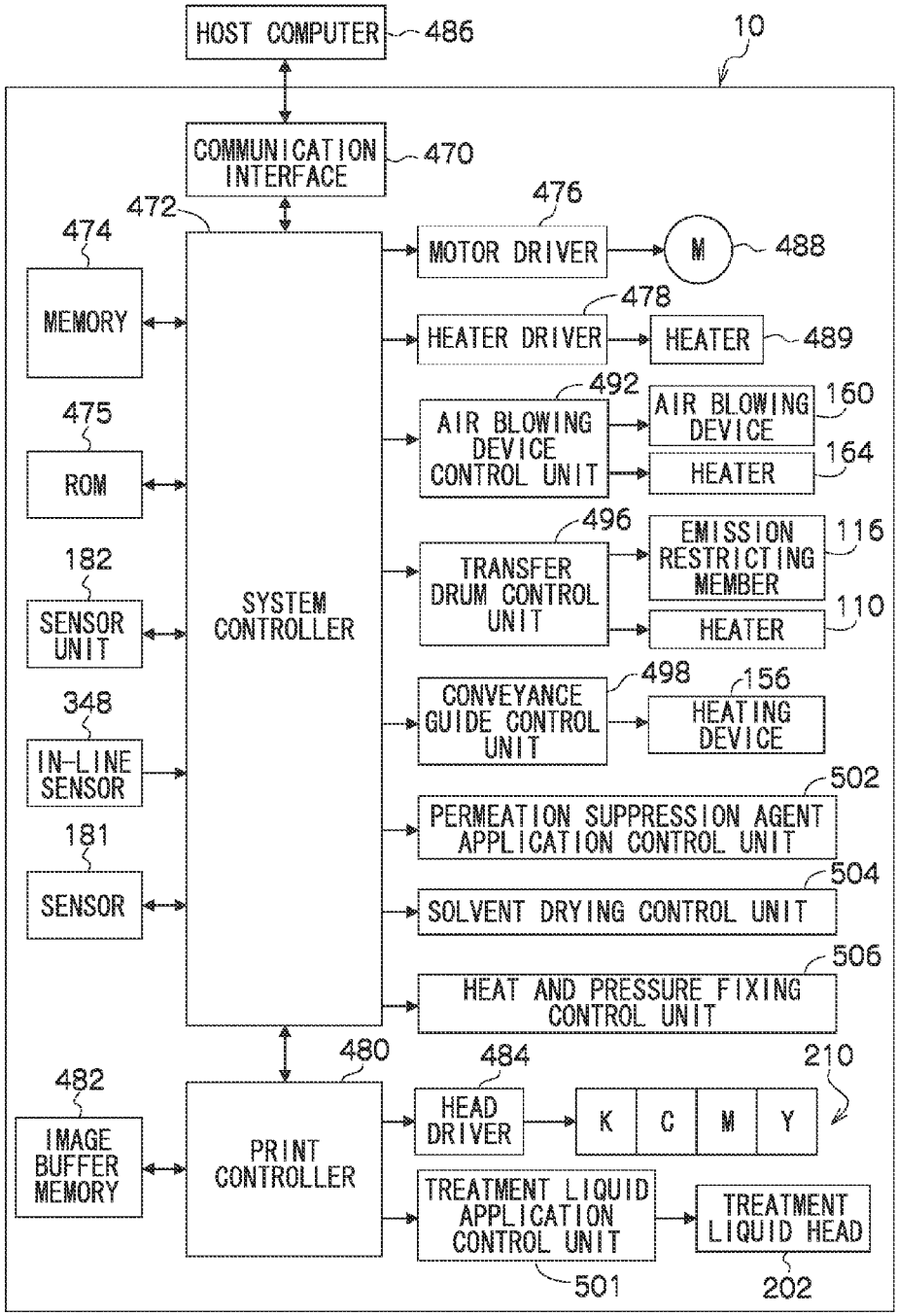
FIG. 16 is a block diagram illustrating the system composition of the inkjet recording apparatus.

FIG. 16 is a principal block diagram illustrating the system configuration of the inkjet recording apparatus 10. The inkjet recording apparatus 10 comprises a communications interface 470, a system controller 472, a memory 474, a ROM 475, a motor driver 476, a heater driver 478, a print control unit 480, an image buffer memory 482, a head driver 484, a treatment liquid deposition control unit 501, and the like.

The communications interface 470 is an interface unit for receiving image data sent from a host computer 486. A serial interface such as USB (Universal Serial Bus), IEEE1394, Ethernet (registered trademark), wireless network, or a parallel interface such as a Centronics interface may be used as the communications interface 470. A buffer memory (not shown) may be mounted in this portion in order to increase the communication speed. The image data sent from the host computer 486 is received by the inkjet recording apparatus 10 through the communications interface 470, and is temporarily stored in the memory 474.

The memory 474 is a storage device for temporarily storing images inputted through the communications interface 470, and data is written and read to and from the memory 474 through the system controller 472. The memory 474 is not limited to a memory composed of semiconductor elements, and a hard disk drive or another magnetic medium may be used.

The system controller 472 is constituted by a central processing unit (CPU) and peripheral circuits thereof, and the like, and it functions as a control device for controlling the whole of the inkjet recording apparatus 10 in accordance with a prescribed program, as well as a calculation device for performing various calculations. More specifically, the system controller 472 controls the various sections, such as the communications interface 470, memory 474, motor driver 476, heater driver 478, and the like, as well as controlling communications with the host computer 486 and writing and reading to and from the memory 474, and it also generates control signals for controlling the motor 488 and heater 489 of the conveyance system.

The program executed by the CPU of the system controller 472 and the various types of data which are required for control procedures are stored in the ROM 475. The ROM 475 may be a non-writeable storage device, or it may be a rewriteable storage device, such as an EEPROM. The memory 474 is used as a temporary storage region for the image data, and it is also used as a program development region and a calculation work region for the CPU.

The motor driver 476 is a driver which drives the motor 488 in accordance with instructions from the system controller 472. In FIG. 16, the motors disposed in the respective sections in the apparatus are represented by the reference numeral 488. The motor 488 includes motors which drive the respective pressure drums 40, 86, 216, 306 and 326, the transfer drums 84, 214, 304, 324 and 344, the paper pressing member 44, the heat roller 328*a*, and the like, illustrated in FIG. 1, and a motor in the mechanism which moves the spiral roller 48 illustrated in FIG. 2 (to separate same from the pressure drum).

The heater driver 478 is a driver which drives the heater 489 in accordance with instructions from the system controller 472. In FIG. 16, the plurality of heaters which are provided in the inkjet recording apparatus 10 are represented by the reference numeral 489. Furthermore, the heater 489 includes the heaters of the permeation suppression agent drying unit 46, the treatment liquid drying unit 204, and the solvent drying unit 308, and the like.

The print control unit 480 has a signal processing function for performing various tasks, compensations, and other types of processing for generating print control signals from the image data stored in the memory 474 in accordance with commands from the system controller 472 so as to supply the generated print data (dot data) to the head driver 484. Prescribed signal processing is carried out in the print control unit 480, and the ejection amount and the ejection timing of the ink droplets from the respective ink heads 210 are controlled via the head driver 484, on the basis of the print data. By this means, desired dot size and dot positions can be achieved.

The print control unit 480 is provided with the image buffer memory 482; and image data, parameters, and other data are temporarily stored in the image buffer memory 482 when image data is processed in the print control unit 480. The aspect illustrated in FIG. 16 is one in which the image buffer memory 482 accompanies the print control unit 480; however, the memory 474 may also serve as the image buffer memory 482. Also possible is an aspect in which the print control unit 480 and the system controller 472 are integrated to form a single processor.

To give a general description of the sequence of processing from image input to print output, image data to be printed is input from an external source via a communications interface 470, and is accumulated in the memory 474. At this stage, RGB image data is stored in the memory 474, for example.

In this inkjet recording apparatus 10, an image which appears to have a continuous tonal graduation to the human eye is formed by changing the droplet ejection density and the dot size of fine dots created by ink (coloring material), and therefore, it is necessary to convert the input digital image into a dot pattern which reproduces the tonal gradations of the image (namely, the light and shade toning of the image) as faithfully as possible. Therefore, original image data (RGB data) stored in the memory 474 is sent to the print control unit 480 through the system controller 472, and is converted to the dot data for each ink color by a half-toning technique, using a threshold value matrix, error diffusion, or the like, in the print control unit 480.

In other words, the print control unit 480 performs processing for converting the input RGB image data into dot data for the four colors of K, C, M and Y. The dot data generated by the print control unit 480 in this way is stored in the image buffer memory 482.

The head driver 484 outputs drive signals for driving the actuators (not shown) corresponding to the respective nozzles 281 of the ink heads 210 (see FIG. 6A), on the basis of the print data supplied by the print control unit 480 (in other words, the dot data stored in the image buffer memory 482). A feedback control system for maintaining constant drive conditions for the heads may be included in the head driver 484.

By supplying the drive signals output by the head driver 484 to the print heads 210 ink is ejected from the corresponding nozzles 281. An image (primary image) is formed on the recording medium 14 by controlling ink ejection from the ink heads 210 while conveying the recording medium 14 at a prescribed speed.

Furthermore, the system controller 472 functions as a device which controls the heated air flow drying using the transfer drum 84, and the like, and the electrostatic attraction by the conveyance guide 150, and duly controls the operation of a heated air flow control unit 492, a transfer drum control unit 496 and a conveyance guide control unit 498. The heated air flow control unit 492 controls the operation of the air blowing devices and heaters (not shown) used for the drying treatment in the transfer drums 84, 214, 304, 324 and 344.

The transfer drum control unit 496 controls the drive mechanism of the emission restricting member 116 illustrated in FIG. 3, as well as controlling the operation of the heater 110. The conveyance guide control unit 498 controls the operation of the heating device 156 illustrated in FIG. 1.

The system controller 472 performs the function of a temporal change measurement and calculation unit 500 which measures the temporal change in the determination signal (measurement information) obtained from the sensors 181 and the sensor unit 182, and controls the transfer drum control unit 496, or the like, in accordance with these calculation results. Furthermore, the system controller 472 controls the operation of the permeation suppression agent application control unit 502, the solvent drying control unit 504 and the heat and pressure fixing control unit 506.

The reflective optical sensor (the composition including the photoreceptor element 521 and the visible light source 522 in FIGS. 10 and 11) included in the sensor unit 182 which is arranged in each of the transfer drums 304, 324 and 344 in FIG. 1 reads in the patch formed by droplets deposited on the non-image portion (the monitoring position 185 in FIG. 4) of the recording medium 14, and the patch data read by the optical sensor is sent to the system controller 472.

Upon acquiring read data from the optical sensor, the system controller 472 sends a command signal to the respective units of the apparatus in order to control the deposition of the permeation suppression agent, the deposition of the treatment liquid and the deposition of ink droplets, in accordance with the read data.

Further, the inkjet recording apparatus 10 in the present embodiment is provided with the treatment liquid head 202, which is the device for depositing the treatment liquid, and the treatment liquid deposition control unit 501, which drives the treatment liquid head 202. The treatment liquid deposition control unit 501 controls the treatment liquid head 202 in accordance with the image data supplied from the print control unit 480. In the case of the liquid application device 42 shown in FIG. 2, the treatment liquid application control unit 501 controls the roller abutment and separation mechanism drive device relating to the spiral roller 48, the rotational drive device of the spiral roller 48, the main blade abutment and separation mechanism drive device, and a precision regulator which adjusts the spraying pressure of the liquid spraying unit 52.

In the case where the inkjet system is employed for the deposition of the treatment liquid, the treatment liquid deposition control unit 501 includes a drive circuit which generates drive signals to be applied to the actuators (not shown) of the treatment liquid head 202 and drives the actuators by applying the drive signals to the actuators. In this way, a desirable mode is one in which a composition for ejecting droplets of the treatment liquid in accordance with the image data is adopted, and the droplets of the treatment liquid are deposited selectively onto the positions where the droplets of the ink have been deposited by the print unit 28. It is also possible to adopt a mode in which the treatment liquid is uniformly deposited by using a spray nozzle.

In the case of the liquid application device 42 illustrated in FIG. 2, the permeation suppression agent application control unit 502 controls the roller abutment and separation mechanism drive device relating to the spiral roller 48, the rotational drive device of the spiral roller 48, the main blade abutment and separation mechanism drive device, and a precision regulator which adjusts the spraying pressure of the liquid spraying unit 52.

The solvent drying control unit 504 controls the operation of the solvent drying unit 308 in the solvent drying unit 30, in accordance with instructions from the system controller 472.

The heat and pressure fixing control unit 506 controls the operation of the cleaning unit 329 in the heat and pressure fixing unit 32, as well as controlling the operation of the fan 332, in accordance with instructions from the system controller 472. Moreover the heat and pressure fixing control unit 506 controls the operation of the heat roller **328*a* as described above with reference to FIG. 15**, on the basis of the recording medium type information acquired by the recording medium type information acquisition unit (not shown).

The system controller 472 obtains the measurement result data relating to the check pattern, moisture content, surface temperature, glossiness, and the like, from the in-line sensor 348 disposed in the output unit 34.

FIG. 17 is a block diagram of the sensor unit 182 shown in FIGS. 10, 11 and 14. As shown in FIG. 17, the determination signal (temperature information) obtained by the infrared sensor 520 is subjected to prescribed signal processing, such as noise reduction, amplification, waveform shaping, and the like, by the signal processing unit 530, and the signal is then sent to the system controller 472 in FIG. 16 through the connecting member 534 and the contact (not shown).

When the system controller 472 acquires the temperature information output from the infrared sensor 520 in FIG. 17, the system controller 472 judges the temperature of the recording medium 14 on the basis of the temperature information. According to the thus obtained temperature of the recording medium 14, the system controller 472 controls the heater 110 and the emission restricting member 116 through the transfer drum control unit 494, and also controls drying by the solvent drying unit 30 (solvent drying unit 308) disposed after the transfer drum 304, through the solvent drying control unit 504.

More specifically, if the temperature of the recording medium 14 is higher than the prescribed temperature setting range, then the amount of heating by the heater 110 and the infrared heater 310 of the solvent drying unit 30 is reduced, whereas if the temperature of the recording medium 14 is lower than the prescribed temperature setting range, then the amount of heating by the heater 110 and the infrared heater 310 of the solvent drying unit 30 is increased.

In this way, by controlling the heating of the respective units which perform the heating process by monitoring the surface temperature of the recording medium 14, it is possible to carry out a stable drying process (heating process) in respect of temperature change and humidity change inside and outside the apparatus, fluctuations due to differences in the type of the recording medium 14, and differences in the image recorded on the recording medium 14 (differences in the ink volume ejected as droplets onto the recording medium).

The determination signal (density information) output from the photoreceptor element 521 in FIG. 17 is sent to the system controller 472 in FIG. 16 through the signal processing unit 536, the connecting member 534, and the contact (not shown).

Upon acquiring this density information, the system controller 472 sends the density information to the print controller 480. In the print controller 480, correction data for the ink droplet ejection volume (ink ejection volume) or correction data for the image data is generated on the basis of the density information, and the ink droplet ejection of the heads 210Y, 210M, 210C and 210K is controlled through the head driver 484 on the basis of this correction data.

For example, if the acquired density value (density information) exceeds the prescribed density value (density range), then the ink droplet ejection volume is reduced in accordance with the difference between the acquired density value and the prescribed density value, and if the density value is less than the prescribed density value, then the ink droplet ejection volume is increased in accordance with the difference between the prescribed density value and the acquired density value. A desirable mode is one where the relationship between the density measurement value and the droplet ejection volume correction value is previously stored in the form of a table, and the droplet ejection volume is corrected by referring to the table.

The on/off switching and amount of light of the visible light source 522 are controlled by the light source driver 538 on the basis of the command signal sent from the system controller 472 in FIG. 16.

According to this composition, since the sensor unit 182, which determines the margin area of the recording medium 14, is arranged at the position in the vicinity of the gripper 87 of the transfer drum 304 for gripping the leading end portion of the recording medium 14, the sensor unit 182 proceeds as the recording medium 14 is conveyed, and therefore the prescribed determination position on the recording medium 14 can be monitored continuously.

Moreover, by providing the temperature sensor (infrared sensor) 520 in the sensor unit 182, it is possible to acquire a history of the temperature of the recording medium 14 with respect to the passage of time while being gripped by the gripper 87, and desirable drying control becomes possible on the basis of the temperature history of the recording medium 14.

Furthermore, by employing the infrared sensor as the temperature sensor 520, and also providing the density sensor which uses visible light in the sensor unit 182, then it is possible to determine the temperature and to determine the optical density simultaneously at the same determination point on the recording medium 14, and it is also possible to control droplet ejection (correct droplet ejection) at the same time as controlling drying.

Operation of the Inkjet Recording Apparatus 10

The action of the image forming apparatus 10 which is composed in this way will now be described.

The recording medium 14 which has been supplied from the paper supply tray 36 is supplied through the transfer drum 38 to the circumferential surface of the pressure drum 40 of the permeation suppression processing unit 24 by a gripper (not shown).

Before being conveyed to the paper supply tray 36, the recording medium 14 is previously stacked in a paper supply unit (not shown) which is preheated to 40° C. to 50° C. The recording medium 14 is supplied to the transfer drum 38 while making contact with an adhesive roller 37 which is provided at a position opposing the paper supply surface of the paper supply tray 36. In this way, the recording medium 14 is heated and dried by preheating the paper supply unit, and it becomes possible to remove foreign material, such as paper dust, or other dust and dirt, by means of the recording medium 14 making contact with the adhesive roller 37, and faster and more stable drying after the application of permeation suppression agent can be achieved.

The recording medium 14 is held on the pressure drum 40 of the permeation suppression processing unit 24 through the transfer drum 38, and permeation suppression agent is applied selectively to a desired region by the liquid application device 42. Thereupon, the recording medium 14 held on the pressure drum 40 is heated by the permeation suppression agent drying unit 46 while being guided by the paper pressing member 44 and conveyed in the direction of rotation of the pressure drum 40, whereby the solvent component (liquid component) of the permeation suppression agent is evaporated off and thereby dried.

The recording medium 14 which has been subjected to permeation suppression processing in this way is transferred from the pressure drum 40 of the permeation suppression processing unit 24 through the transfer drum 84 to the pressure drum 86 of the treatment liquid deposition unit 26. On the transfer drum 84, the permeation suppression agent is heated and dried by the conveyance guide 150, by non-contact drying of the printed surface. Droplets of the treatment liquid are deposited by the treatment liquid head 202 onto the recording medium 14 which is held on the pressure drum 86. Thereupon, the recording medium 14 which is held on the pressure drum 86 is heated by the treatment liquid drying unit 204, and the solvent component (liquid component) of the treatment liquid is evaporated and dried. By this means, a layer of aggregating treatment agent in a solid state or semi-solid state is formed on the recording medium 14.

The recording medium 14 on which the solid or semi-solid layer of aggregating treatment agent has been formed is transferred from the pressure drum 86 of the treatment liquid deposition unit 26 through the transfer drum 214 to the pressure drum 216 of the print unit 28. On the transfer drum 214, acid is left on the permeation suppression layer by the non-contact drying of the printed surface by the conveyance guide 150. Droplets of corresponding colored inks are ejected respectively from the ink heads 210K, 210C, 210M and 210Y, onto the recording medium 14 held on the pressure drum 216, in accordance with the input image data.

When ink droplets are deposited onto the aggregating treatment agent layer, then the contact surface between the ink droplets and the aggregating treatment agent layer has a prescribed surface area when the ink lands, due to a balance between the propulsion energy and the surface energy. An aggregating reaction starts immediately after the ink droplets have landed on the aggregating treatment agent, but the aggregating reaction starts from the contact surface between the ink droplets and the aggregating treatment agent layer. Since the aggregating reaction occurs only in the vicinity of the contact surface, and the coloring material in the ink aggregates while receiving an adhesive force in the prescribed contact surface area upon landing of the ink, then movement of the coloring material is suppressed.

Even if another ink droplet is deposited adjacently to this ink droplet, since the coloring material of the previously deposited ink will already have aggregated, then the coloring material does not mix with the subsequently deposited ink, and therefore bleeding is suppressed. After aggregation of the coloring material, the separated ink solvent spreads, and a liquid layer containing dissolved aggregating treatment agent is formed on the recording medium 14.

The recording medium 14 onto which ink has been deposited is transferred from the pressure drum 216 of the print unit 28 through the transfer drum 304 to the pressure drum 306 of the solvent drying unit 30. On the transfer drum 304, the printed surface of the recording medium 14 is dried by a non-contact method, by the conveyance guide 150. On the pressure drum 306, the water content is removed sufficiently by irradiation of infrared energy and blowing of a heated air flow by the solvent drying unit 308.

Thereupon, the recording medium 14 is transferred from the pressure drum 306 of the solvent drying unit 30 through the transfer drum 324 to the pressure drum 326 of the heat and pressure fixing unit 32. The drying is also carried out on the transfer drum 324 similarly to that on the transfer drum 304. The image is fixed to the recording medium 14 and subjected to the heat and pressure fixing treatment by applying heat and pressure by means of the heat rollers 328*a*, 328*b*, 328*c* to the recording medium 14 that has been transferred to the pressure drum 326, which is heated by a heating device (not shown).

Thereupon, the recording medium 14 is transferred to an output tray 346 of the output unit 34 from the pressure drum 326 of the heat and pressure fixing unit 32 via the transfer drum 344, and is output to the exterior of the machine. The transfer drum 344 is heated by a heating device (not shown) and promotes further permeation of the high-boiling-point solvent and correction of curl in the recording medium 14.

Instead of the pressure drum 306 disposed in the solvent drying unit 30 and the transfer drums 304 and 324 disposed before and after same as shown in FIG. 1, it is also possible to adopt a mode which employs a conveyance device using a chain (not shown).

In an embodiment of such the configuration, the chain has grippers for holding the recording medium 14, and is wrapped about sprockets for driving the chain. A heated air flow blowing device is arranged inside the conveyance path of the chain, and an attractive guide which electrostatically attracts the rear surface of the recording medium 14 is disposed at a position opposing the conveyance face of the chain.

When this attractive guide is composed similarly to the conveyance guide 150 described with reference to FIG. 3, the attractive guide performs a similar role to the conveyance guide 150. Drying is performed by blowing a heated air flow from the heated air flow blowing device while conveying the recording medium 14 by the grippers of the chain and attracting the recording medium 14 electrostatically with the attractive guide disposed opposing the chain. Instead of or in combination with the heated air flow blowing device, it is also possible to perform heating and drying by using a drying unit similar to the solvent drying unit 308 illustrated in FIG. 1. In this case also, as well as obtaining similar beneficial effects as the inkjet recording apparatus according to the embodiment illustrated in FIG. 1, the heating unit can be simplified, and therefore this mode is suitable for cases where the amount of drying is small, for instance, where the number of ink colors is small.

Preparation of Liquids

Next, adjustment examples of liquids used in the inkjet recording apparatuses 10 according to the above-described embodiments are explained.

(1) Preparation of Permeation Suppression Agent

A mixed solution was prepared by mixing 10 g of a dispersion stabilizer resin (Q-1) having the following structure:

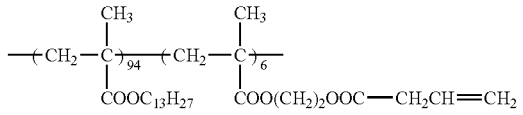

$\overline{M}w=4\times10^4$ (Weight Composition Ratio), 100 g of vinyl acetate and 384 g of Isopar H (made by ExxonMobil), and was heated to a temperature of 70° C. while being agitated in a nitrogen gas flow. Then, 0.8 g of 2,2'-azobis(isovaleronitrile) (A.I.V.N.) was added as a polymerization initiator, and the mixture was made to react for 3 hours. 20 minutes after adding the polymerization initiator, white turbidity was produced and the reaction temperature rose to 88° C. A further 0.5 g of polymerization initiator was added and after making reaction for 2 hours, the temperature was raised to 100° C. and the mixture was agitated for 2 hours. Then, vinyl acetate that had not reacted was removed. The mixture was cooled and then passed through a 200-mesh nylon cloth. The white dispersed material thereby obtained was a latex having a polymerization rate of 90%, an average particle size of 0.23 μm and good monodisperse properties. The particle size was measured with a CAPA-500 (made by HORIBA, Ltd.).

A portion of the white dispersed material was placed in a centrifuge (for example, rotational speed: $1\times10^4$ r.p.m.; operating duration: 60 minutes), and the precipitated resin particles were collected and dried. The weight-average molecular weight (Mw), glass transition point (Tg) and minimum film forming temperature (MFT) of the resin particles were measured as follows: Mw was $2\times10^5$ (GPC value converted to value for polystyrene), Tg was 38° C. and MFT was 28° C.

(2) Preparation of Aggregating Treatment Agent

<Preparation of Treatment Liquid T-1>

As a result of preparation of the treatment liquid in accordance with the composition shown in the following Table 2 and measurement of properties of the reaction liquid thus obtained, the viscosity was 4.9 mPa·s, the surface tension was 24.3 mN/m and the pH was 1.5.

TABLE 2

| Material | Weight % |
|---|---|
| Malonic acid (made by Wako Pure Chemical Industries) | 10 |
| Diethylene glycol monomethyl ether (made by Wako Pure Chemical Industries | 15 |
| Trioxypropylene glyceryl ether (Sannix GP250 (made by Sanyo Chemical Industries)) | 5 |
| Latex LX-1 | 2 |
| Zonyl FSN-100 (made by Du Pont) | 1 |
| Deionized water | 67 |

By using the above aggregating treatment agent, it is possible to deposit the aggregating treatment agent bringing about good effects on the head ejection performance and the wettability of the recording medium.

(3) Preparation of Ink

<Preparation of Polymer Dispersant P-1>

88 g of methylehtyl ketone was introduced into a 1000 ml three-mouthed flask fitted with an agitator and cooling tube, and was heated to 72° C. in a nitrogen atmosphere, whereupon a solution formed by dissolving 0.85 g of dimethyl 2,2'-azobis isobutylate, 60 g of benzyl methacrylate, 10 g of methacrylic acid and 30 g of methyl methacrylate in 50 g of methylethyl ketone was added to the flask by titration over three hours. When titration had been completed and after reacting for a further hour, a solution of 0.42 g of dimethyl 2,2'-asobis isobutylate dissolved in 2 g of methylethyl ketone was added, the temperature was raised to 78° C. and the mixture was heated for 4 hours. The reaction solution thus obtained was deposited twice in an excess amount of hexane, and the precipitated resin was dried, yielding 96 g of a polymer dispersant P-1.

The composition of the resin thus obtained was confirmed using a 1H-NMR, and the weight-average molecular weight (Mw) determined by GPC (Gel Permeation Chromatography) was 44600. Moreover, the acid number of the polymer was 65.2 mg KOH/g as determined by the method described in Japanese Industrial Standards (JIS) specifications (JIS K 0070-1992).

<Preparation of Cyan Dispersion Liquid>

10 parts of Pigment Blue 15:3 (phthalocyanine blue A220 made by Dainichi Seika Color & Chemicals), 5 parts of the polymer dispersant P-1 obtained as described above, 42 parts of methylethyl ketone, 5.5 parts of an aqueous 1 mol/L NaOH solution, and 87.2 parts of deionized water were mixed together, and dispersed for 2 to 6 hours using 0.1 mm diameter zirconia beads in a beads mill.

The methylethyl ketone was removed from the obtained dispersion at 55° C. under reduced pressure, and moreover a portion of the water was removed, thus obtaining a cyan dispersion liquid having a pigment concentration of 10.2 wt %.

The cyan dispersion liquid forming a coloring material was prepared as described above.

Using the coloring material (cyan dispersion liquid) obtained as described above, an ink was prepared so as to achieve the ink composition indicated below (Table 3), and the prepared ink was then passed through a 5 μm filter to remove coarse particles, thereby obtaining a cyan ink C1-1. Thereupon, the physical properties of the ink C1-1 thus obtained were measured, and the pH was 9.0, the surface tension was 32.9 mN/m, and the viscosity was 3.9 mPa·s.

TABLE 3

| Material | Weight % |
|---|---|
| Cyan pigment (Pigment Blue 15:3) (made by Dainichiseika Color & Chemicals Mfg.) | 4 |
| Polymer dispersant (P-1 mentioned above) | 2 |
| Latex LX-2 | 8 |
| Trioxypropylene glyceryl ether (Sannix GP250 (made by Sanyo Chemical Industries)) | 15 |
| Olefin E1010 (Nissin Chemical Industry) | 1 |
| Deionized water | 70 |

Magenta, yellow and black inks were also prepared in a similar manner.

(4) Added Polymers

Particles of polymer resin, or the like, are added as appropriate to the aggregating treatment agent and ink described above. Desirably, particles having a particle size of 1 μm or less, the minimum film foaming temperature (MFT) of 28° C. to 50° C., and the glass transition point (Tg) of 40° C. to 60° C. are added at a rate of 1% to 8%, to the aggregating treatment agent, for the purpose of adjusting the glossiness, and to the ink, for the purpose of fixing the image.

TABLE 4

| Category | Composition | Particle size (diameter) | Tg | MFT |
|---|---|---|---|---|
| LX-2 | Acrylic | 0.12 μm | 65° C. | 47° C. |
| | Styrene acrylic | 0.09 μm | 65° C. | 32° C. |
| | Styrene acrylic | 0.07 μm | 49° C. | 46° C. |

The compositions and formulations of the respective liquids described above are no more than examples, which can be changed as appropriate.

By means of the above-described heat and pressure fixing process, the heat roller 328*a* which functions as the heat and pressure fixing device can be moved in the upward/downward direction, and the heat roller 328*a* is composed to be switchable between pressing and separation with respect to the recording medium 14 held on the pressure drum 326. If using a recording medium 14 which is subjected to the heat and pressure fixing process without applying pressure, such as a matt-coated paper, the heat roller 328*a* is separated from the recording medium 14 and therefore the surface glossiness of the low-gloss paper is stable.

If the heat roller 328*a* is separated from the recording medium 14 and the heat and pressure fixing process is carried out without applying pressure, the temperature setting of the heat roller 328*a* is raised compared to when the heat roller 328*a* is pressed against the recording medium 14, and the ink drying and fixing properties on the recording medium 14 are ensured by the radiated heat on the heat roller 328*a*.

Moreover, since the air is emitted by the fan 332 from the downstream side to the upstream side of the heat roller 328*a* in terms of the medium conveyance direction, then if the heat roller 328*a* is separated from the recording medium 14, drying of the ink is promoted due to the heated air flow passing between the heat roller 328*a* and the recording medium 14, in addition to which floating up of the recording medium 14 is suppressed. If the heat roller 328*a* is pressed against the recording medium 14, then the air is emitted onto the contacting portion between the heat roller 328*a* and the recording medium 14, and the separating properties of the heat roller 328*a* are improved.

Furthermore, when carrying out the heat and pressure fixing process by applying pressure, since the heat roller 328*a* is pressed against the recording medium 14 before the image formation region of the recording medium 14 and separated after passing the image formation region, then even if carrying out the heat and pressure fixing process by applying pressure, it is possible to release the air and relieve distortion due to the pressing of the roller, in each image, temperature and humidity change in the vicinity of the heat roller 328*a* is suppressed, and separating properties, drying and fixing properties and pressing stability are further improved.

On the other hand, when carrying out the heat and pressure fixing process without applying pressure, the heat roller 328*a* is pressed against the recording medium 14 after passing the image formation region of the recording medium 14 and is separated immediately before passing the gripper, and therefore it is possible to rotate the heat roller 328*a* intermittently, local heating of the heat roller 328*a* (and local cooling due to the air from the fan 332 striking the same position) is suppressed, and the efficiency of use of the heat is improved.

Modified Embodiment

Next, a modification of the above-described embodiment is explained.

The heat and pressure fixing process according to the present modified embodiment is composed in such a manner that the temperature and the reflective density of a patch formed at a monitoring position 185 (see FIG. 4) in a blank margin portion of the recording medium 14 are measured in synchronism with the movement of the recording medium 14, before and after the heat and pressure fixing process, and the temperature and the applied pressure (nip pressure) employed in the heat and pressure fixing process are controlled on the basis of the measurement results.

Furthermore, by adopting a composition which makes it possible to change the light reception angle of the photoreceptor element 521 and the irradiation angle of the visible light source 522 in the reflective optical sensor shown in FIG. 11, then the reflective optical sensor can be used as a device for measuring glossiness (gloss meter), and a glossiness value can be measured instead of the reflective density.

More specifically, the sensor unit 182 is provided with a movement mechanism which moves the photoreceptor element 521, the visible light source 522 and the lenses 525 and 526, and the glossiness is measured by moving the photoreceptor element 521, the visible light source 522 and the lenses 525 and 526 in accordance with the measurement conditions.

FIG. 18A shows a case where the angle between the normal of the object and the normal of the measurement plane is 20°, which is a mode generally used to measure objects of high glossiness. FIG. 18B shows a case where the angle between the normal of the object and the normal of the measurement plane is 60°, which is used for objects of low glossiness. Moreover, by adopting a composition whereby the angle can be adjusted between 20° and 80°, for instance, to 45°, 75° and 80°, as appropriate, it is possible to measure glossiness over a broad range according to the user's requirements.

By adopting the above-described gloss meter functions in the sensor units 182 of the transfer drum 324 and the transfer drum 344, it is possible to control the glossiness with even higher precision by measuring the glossiness before and after the heat and pressure fixing process, and feeding the measurement results back into the heat and pressure fixing process.

Second Embodiment

Next, a heat and pressure fixing unit 32' (second example) having two heat rollers 328*a* and 328*b* is described as a second embodiment of the present invention.

Figure 19:
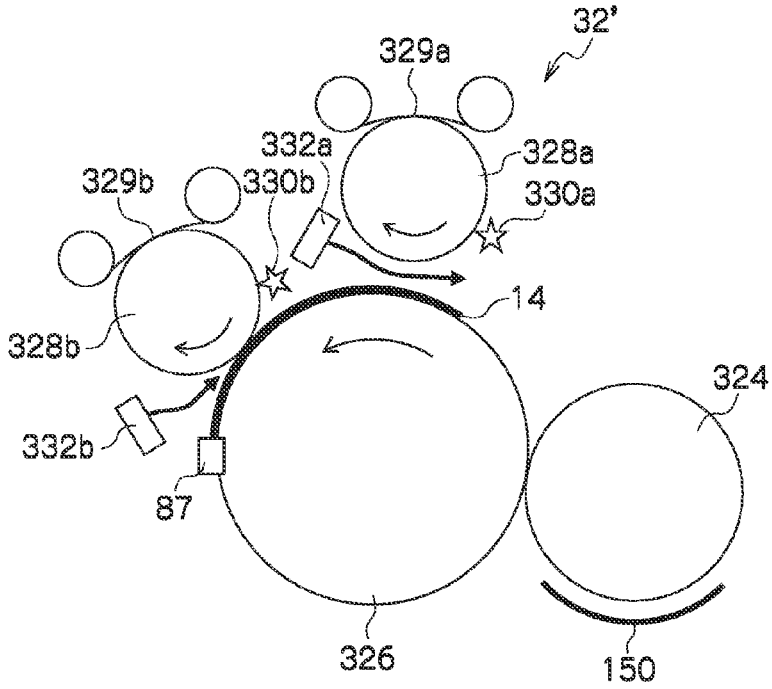
FIG. 19 is a schematic drawing of a heat and pressure fixing unit according to a second embodiment of the present invention.

FIG. 19 is an approximate schematic drawing of the heat and pressure fixing unit 32' according to the second embodiment. The composition of the heat and pressure fixing unit 32' shown in FIG. 19 is the same as the heat and pressure fixing unit 32 shown in FIGS. 12A and 12B, apart from the fact of further including the heat roller 328*b*, a cleaning unit 329*b*, a fan 332*b* and a star wheel 330*b*. The heat roller 328*b*, the cleaning unit 329*b*, the fan 332*b* and the star wheel 330*b* respectively have the same functions and forms as the heat roller 328*a*, the cleaning unit 329*a*, the fan 332*a* and the star wheel 330*a* shown in FIG. 19. In FIG. 19, the heat roller 328, the cleaning unit 329, the fan 332 and the star wheel 330 in FIGS. 12A and 12B are respectively depicted as the heat roller 328*a*, the cleaning unit 329*a*, the fan 332*a* and the star wheel 330*a*.

In the heat and pressure fixing process performed by the single heat roller 328 shown in FIGS. 12A and 12B, there may be insufficient processing time. Hence, the heat and pressure fixing unit 32' is further provided with the heat roller 328*b* in order to supplement this insufficiency in the processing time. In the composition including the two heat rollers 328*a* and 328*b* shown in FIG. 19, the heat and pressure fixing process of higher precision is achieved by being able to independently control the heat rollers 328*a* and 328*b*.

For example, since the drying and permeation of the ink, and the like, has progressed to a lesser extent on the upstream side compared to the downstream side, in terms of the medium conveyance direction, then the heat and pressure fixing process is made relatively weaker on the upstream side, whereas since the drying and permeation of the ink, and the like, has progressed to a greater extent on the downstream side, then the heat and pressure fixing process is made relatively stronger on the downstream side. In other words, a highly efficient heat and pressure fixing process can be performed while restricting to a minimum any damage caused to the image by raising the temperature and increasing the pressure in accordance with the progress of permeation and drying of the ink, and the like.

Table 5 shows examples of the composition and settings of the heat rollers 328*a* and 328*b*, each of which has a flat surface of a PFA coating, or the like, on the rubber. The rubber hardness (35° to 70°) of the heat roller 328*b* is higher than the rubber hardness (15° to 35°) of the heat roller 328*a*, the surface temperature setting (80° C. to 100° C.) of the heat roller 328*b* is higher than the surface temperature setting (60° C. to 80° C.) of the heat roller 328*a*, and the nip pressure setting (0.2 MPa to 0.3 MPa) of the heat roller 328*b* is higher than the nip pressure setting (0.05 MPa to 0.2 MPa) of the heat roller 328*a*.

TABLE 5

| Heat roller | Rubber hardness (with PFA coating) | Surface temperature | Pressure (nip pressure) |
|---|---|---|---|
| 328a | 15° to 35° | 60° C. to 80° C. | 0.05 MPa to 0.2 MPa |
| 328b | 35° to 70° | 80° C. to 100° C. | 0.2 MPa to 0.3 MPa |

Table 6 shows a list of types of recording media 14, and the corresponding pressing control and separation control of the heat rollers 328*a* and 328*b*. In Table 6, "on" means that the heat roller is pressed against the recording medium, and "off" means that the heat roller is separated from the recording medium.

TABLE 6

| Combination No. | Heat roller 328a | Heat roller 328b | Application |
|---|---|---|---|
| 1 | Off | Off | Matt-coated paper, repeat pass gloss processing, maintenance, error processing (drying defect, etc.) |
| 2 | Off | On | Medium-gloss processing of gloss-coated paper |
| 3 | On | Off | Low gloss processing of gloss-coated paper, gloss-matt paper |
| 4 | On | On | High-gloss processing of gloss-coated paper |

In cases of matt-coated paper, repeat pass gloss processing, maintenance and error processing, the combination No. 1 is used where both of the heat rollers 328*a* and 328*b* are "off". The "repeat pass gloss processing" is carried out with respect to a recorded image that cannot withstand a fixing process which applies pressure, and whereby the recording medium is passed in a state where the heat rollers 328*a* and 328*b* are separated and fixing is slightly applied, whereupon the recording medium is passed again. The "maintenance" is carried out for the heat rollers 328*a* and 328*b*. The "error processing" is a case where the recording medium is passed without carrying out the heat and pressure fixing process due to a drying defect, or the like.

In a case of medium-gloss processing of gloss-coated paper, the combination No. 2 is used where the heat roller 328*a* is "off" and the heat roller 328*b* is "on". In other words, the combination No. 2 is used for the cases where the glossiness is adjusted by applying a weak pressure at low temperature.

In cases of low-gloss processing of gloss-coated paper, and matt-coated paper, the combination No. 3 is used where the heat roller 328*a* is "on" and the heat roller 328*b* is "off". In other words, the combination No. 3 is used for the cases where the glossiness is adjusted by applying a stronger pressure at a higher temperature than the combination No. 2.

In a case of high-gloss processing of gloss-coated paper, the combination No. 4 is used where the heat rollers 328*a* and 328*b* are both "on". In other words, the combination No. 4 is used for the cases where the glossiness is adjusted by applying a high pressure at a high temperature.

The set temperatures and the nip pressures shown in Table 5 and the on/off statuses of the heat rollers 328*a* and 328*b* shown in Table 6 are stored in a prescribed memory in association with the types of recording media 14, and the temperature, nip pressure, and on/off switching of the heat rollers 328*a* and 328*b* are controlled in accordance with information about the type of the recording medium 14, by referring to this memory.

A desirable mode is one where a user interface is provided (a touch panel type of monitor device, a keyboard, mouse, joystick, or the like), in such a manner that the user can freely set the above-described combination Nos. 1 to 4, according to requirements.

Furthermore, in the present embodiment, the control of the pressing and separation of the heat roller 328*a* described above with reference to FIG. 15 is employed.

According to the second embodiment, in addition to providing the plurality of heat rollers, the composition that enables the pressing and separation of each roller to be independently controlled is adopted, and by making at least one condition of the temperature, pressure and smoothness (rubber hardness of the heat roller surface) on the upstream side lower than on the downstream side in terms of the medium conveyance direction, problems such as roller offset, and the like, can be avoided by suitable pressing of the rollers in accordance with the progress of drying and fixing of the ink, and the like. Furthermore, by combining control of the plurality of heat rollers, it is possible to set the glossiness (gloss adjustment) in accordance with the type of recording medium and the user's wishes.

Third Embodiment

Next, a heat and pressure fixing unit 32" (third example) having three heat rollers 328*a*, 328*b* and 328*c* is described as a third embodiment of the present invention.

Figure 20:
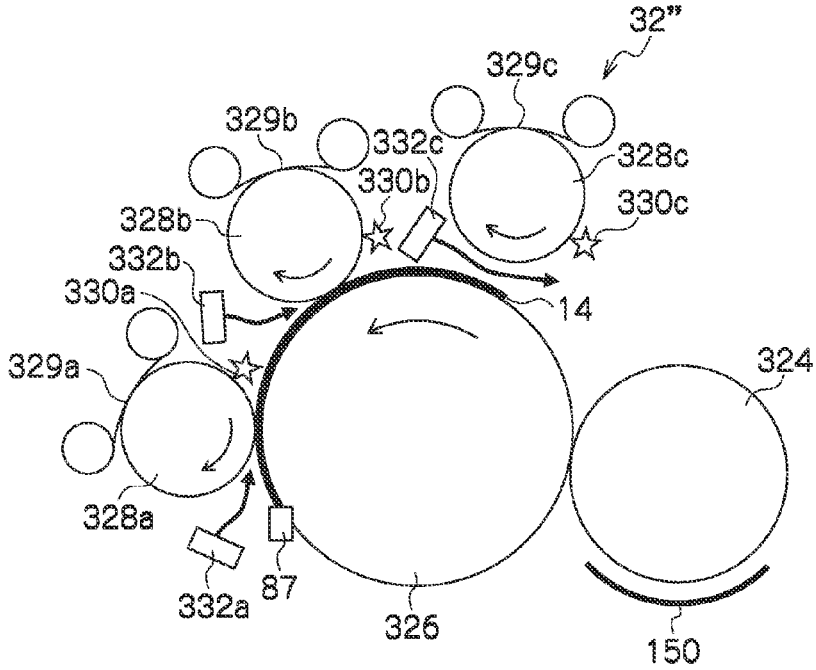
FIG. 20 is a schematic drawing of a heat and pressure fixing unit according to a third embodiment of the present invention.

FIG. 20 is an approximate schematic drawing of the heat and pressure fixing unit 32" according to the third embodiment. The composition of the heat and pressure fixing unit 32" shown in FIG. 20 is the same as the heat and pressure fixing unit 32' shown in FIG. 19, apart from the fact of further including a heat roller 328*c*, a cleaning unit 329*c*, a fan 332*c* and a star wheel 330*c*.

By means of the heat and pressure fixing unit 32" shown in FIG. 20, there is richer variation of control than the mode shown in FIGS. 12A and 12B and the mode shown in FIG. 19, and it is possible to obtain a suitable surface gloss in accordance with the recording medium 14.

More specifically, the heat and pressure fixing unit 32" is provided with the heat roller 328*a* which is set to a low temperature and pressure, the heat roller 328*b* which is set to a medium temperature and pressure, and the heater roller 328*c* which is set to a high temperature and pressure, in positions opposing the circumferential surface of the pressure drum 326, in sequence from the upstream side in terms of the direction of rotation of the pressure drum 326 (the counter-clockwise direction in FIG. 20). The fans 332*a*, 332*b* and 332*c* capable of blowing air onto the recording medium 14 are arranged from the downstream side toward to the upstream side in terms of the medium conveyance direction, in the vicinity of the heat roller 328*a*, 328*b* and 328*c*, respectively.

Furthermore, desirably, the temperatures and the pressures of the heat rollers are set on the basis of damage, such as roller offset, coloring material fixing properties and glossiness, and Table 7 below shows one example of these settings.

TABLE 7

| Heat roller | Rubber hardness (with PFA coating) | Surface temperature | Pressure (nip pressure) |
|---|---|---|---|
| 328a | 15° to 25° | 60° C. to 70° C. | 0.05 MPa to 0.1 MPa |
| 328b | 25° to 35° | 70° C. to 85° C. | 0.1 MPa to 0.2 MPa |
| 328c | 35° to 70° | 85° C. to 100° C. | 0.2 MPa to 0.3 MPa |

Table 8 shows examples of combinations of pressing (on) of the heat rollers 328*a*, 328*b* and 328*c* against the pressure drum 326 and separation (release) (off) of the rollers from the pressure drum 326.

TABLE 8

| Combination No. | Heat roller 328a | Heat roller 328b | Heat roller 328c | Application |
|---|---|---|---|---|
| 5 | Off | Off | Off | Fine-coated paper, matt-coated paper, repeat pass gloss processing, maintenance, error processing (drying defect, etc.) |
| 6 | Off | Off | On | Medium-gloss processing of wide gloss-coated paper |
| 7 | Off | On | Off | Wide gloss-matt paper, medium-gloss processing of narrow gloss-coated paper |
| 8 | Off | On | On | High-gloss processing of wide gloss-coated paper |
| 9 | On | Off | Off | Narrow gloss-matt paper |
| 10 | On | Off | On | Very-high-gloss processing of wide gloss-coated paper, high-gloss processing of narrow thick gloss-coated paper |
| 11 | On | On | Off | High-gloss processing of narrow gloss-coated paper |

TABLE 8-continued

| Combination No. | Heat roller 328a | Heat roller 328b | Heat roller 328c | Application |
|---|---|---|---|---|
| 12 | On | On | On | Very-high-gloss processing of wide gloss-coated paper, high-gloss processing of wide thick gloss-coated paper |

In a case of high-gloss processing of wide gloss-coated paper (B4 to half-Kiku size: 542 mm to 636 mm in width), the combination No. 8 is used where the heat rollers 328*b* and 328*c* are pressed, and the heat roller 328*a* is separated from the pressure drum 326 by the movement mechanism (not shown) while being heated to 100° C. to 180° C. By conveying the recording medium 14 in this state, the surface is smoothed, the glossiness is raised, and the image can be fixed reliably to the recording medium 14 by heat and pressure. Since the temperatures and the pressures of the heat rollers are set in accordance with the progress of the permeation of the ink solvent into the recording medium 14, then it is possible to reduce problems (roller offset), such as adherence of ink onto the heat roller.

Furthermore, since the air is emitted onto the recording medium 14 using the fans 332*a* to 332*c* from the downstream side in the medium conveyance direction over the heat rollers 328*a* to 328*c*, then the separating properties of the pressed heat rollers 328*b* and 328*c* are improved, the drying and fixing of ink is promoted by the separated heat roller 328*a*, and floating up of the recording medium is also reduced.

The heat rollers 328*b* and 328*c* are pressed immediately before the image portion (see FIG. 15) and are prevented from interfering with the grippers by being separated in the non-image portion, whereby the emitted air escapes and the temperature and the humidity in the vicinity of the heat rollers 328*b* and 328*c* are stabilized. Moreover, by pressing the separated heat roller 328*a* in the non-image portion of the trailing end of the recording medium, the heat roller 328*a* is rotated and localized heating of the heat roller 328*a* is prevented, thereby improving the efficiency of use of the heat also.

In a case where the glossiness is to be reduced, due to the subject image (a text image, for instance), or user preferences, and a case of wide gloss-matt paper, the combination No. 6 or 7 is used where either one of the heat rollers 328*b* and 328*c* is pressed. In a case of matt-coated paper, the combination No. 5 is used where all of the heat rollers 328*a* to 328*c* are separated.

In cases where the recording medium 14 is a narrow paper (A4 to Kiku 4: 440 mm to 469 mm in width), the combination No. 11 is used where the heat and pressure fixing process is carried out by pressing the heat rollers 328*a* and 328*b*, and if the glossiness is to be reduced, or in a case of gloss-matt paper, then the combination No. 7 or 9 is used where either one of the heat rollers 328*a* and 328*b* is pressed. In a case of narrow matt-coated paper, the combination No. 5 is used where all of the heat rollers 328*a* to 328*c* are separated.

Moreover, if the glossiness is insufficient with the above-mentioned settings in the case of thick gloss-coated paper, for instance, then this is handled by the combination No. 10 or 12 where the combination of heat rollers is changed.

In the cases of maintenance of the apparatus and error processing, such as a drying defect of the recording medium 14, the combination No. 5 is used where all of the heat rollers 328*a*, 328*b* and 328*c* are separated from the pressure drum 326 and it is then possible to prevent adherence of ink to the heat rollers. If the coating layer is thin and weak and the image is difficult to immediately fix to the recording medium, then it is also possible to separate all of the heat rollers, pass the recording medium, and when the fixing properties have improved after time has elapsed, pass the recording medium again without applying treatment liquid or ink, and then carry out the heat and pressure fixing process by means of the heat rollers.

According to the third embodiment, the heat and pressure fixing unit 32" is provided with the three heat rollers 328*a*, 328*b* and 328*c* in which at least one of the temperatures, the pressures and the smoothnesses are set to become lower toward the upstream side in terms of the medium conveyance direction, and if wide paper is used, then the two heat rollers 328*a* and 328*b* on the downstream side in terms of the medium conveyance direction are pressed against the recording medium, whereas when narrow paper is used (paper having approximately 70% of the width of the wide paper), then the two heat rollers 328*b* and 328*c* on the upstream side in terms of the medium conveyance direction are pressed against the recording medium, whereby it is possible to carry out a stable heat and pressure fixing process (glossiness adjustment) even when using the recording media of different widths, and compatibility with an even stronger heat and pressure fixing process can be achieved.

By increasing the variations of the heat and pressure fixing process (glossiness adjustment), it is possible to respond to recording media of various different types and to the user's preferences.

The above-described embodiments are related to the apparatus that forms an image by making the ink react with the treatment liquid having a function of aggregating (or insolubilizing) the coloring material contained in the ink; however, the present invention can also be applied to an apparatus that fixes ink onto a recording medium without using any treatment liquid.

The inkjet recording apparatuses and the fixing treatment methods according to the embodiments of the present invention have been described in detail above, but the present invention is not limited to the embodiments described above, and improvements and modifications can be made without deviating from the gist of the present invention.

APPENDIX

As has become evident from the detailed description of embodiments of the present invention given above, the present specification includes disclosure of various technical ideas described below.

A fixing processing apparatus comprises: a conveyance device which conveys a recording medium in a prescribed conveyance direction along a conveyance path, a desired image having been recorded in an image formation region on an image formation surface of the conveyed recording medium; a heat and pressure fixing device which is arranged in the conveyance path and carries out heat and pressure fixing process in which the image formation surface of the recording medium is subjected to at least one of heating process, pressing process and non-pressing process, the heat and pressure fixing device applying pressure to the image formation region while making contact with the image formation surface at a contact position in the conveyance path in the pressing process, the heat and pressure fixing device applying no pressure to the image formation region in the non-pressing process; a switching device which switches between pressing and separation of the heat and pressure fixing device with respect to the recording medium; a switching control device which controls the switching device in such a manner that the recording medium and the heat and pressure fixing device are mutually separated in the non-pressing process; and a setting device which sets a temperature of the heat and pressure fixing device to be higher in the non-pressing process than in the pressing process.

According to the present embodiment, in the case of the non-pressing process in which pressure is not applied, damage to the image (for example, the coating layer of low-gloss paper) is reduced by separating the heat and pressure fixing device from the recording medium, and therefore the glossiness of the image surface is stable. Furthermore, by raising the set temperature in the case of the non-pressurized process, the drying and fixing of the image are carried out reliably by means of radiated heat. Moreover, soiling of the heat and pressure fixing device due to drying defects is prevented.

The "recording medium" may also be called a print medium, an image forming medium, a recording medium, or an image receiving medium, or the like. Furthermore, the recording medium is not limited to a case where an image is formed directly onto the medium, and the concept of "recording medium" also includes an intermediate transfer body onto which a primary image is formed provisionally and then transferred so as to record the image (secondary image) onto paper, or the like. There are no particular restrictions on the shape or material of the recording medium, which may be various types of media, irrespective of material and size, such as sheet paper (cut paper), sealed paper, continuous paper, resin sheets, such as OHP sheets, film, cloth, a printed circuit substrate on which a wiring pattern, or the like, is formed, a rubber sheet, a metal sheet, or the like.

The conveyance device for causing the recording medium and the heat and pressure fixing device to move relatively to each other may include a mode where the recording medium is conveyed with respect to a stationary (fixed) heat and pressure fixing device, or a mode where the heat and pressure fixing device is moved with respect to a stationary recording medium, or a mode where both the heat and pressure fixing device and the recording medium are moved.

Preferably, the fixing processing apparatus further comprises an air emitting device which emits air toward the recording medium and is arranged in the conveyance path on a downstream side of the heat and pressure fixing device in terms of the conveyance direction.

According to this mode, in the case of the non-pressurized process, air is emitted between the recording medium and the heat and pressure fixing device, thereby promoting drying of the image and preventing floating up of the recording medium. Furthermore, in the case of the pressing process, air is emitted onto the contact region between the recording medium and the heat and pressure fixing device, thereby improving the separating characteristics of the recording medium.

Preferably, in the non-pressing process, the switching control device controls the switching device in such a manner that the heat and pressure fixing device is pressed against the recording medium immediately after the image formation region has passed the contact position.

According to this mode, the air flow emitted from the emitting device does not strike a localized portion of the heat and pressure fixing device, and therefore localized heating (cooling) of the heat and pressure fixing device is suppressed and improvement in the efficiency of use of the heat can be expected. Furthermore, floating up of the trailing end portion of the recording medium is suppressed.

Preferably, in the non-pressing process, the switching control device controls the switching device in such a manner that the heat and pressure fixing device is separated from the recording medium after a trailing end portion of the recording medium has passed the contact position and before a leading end portion of a succeeding recording medium arrives at the contact position.

According to this mode, interference between the next recording medium (the holding member holding the leading end portion of the next recording medium) and the heat and pressure fixing device is prevented.

Preferably, the switching control device controls the switching device in such a manner that the recording medium and the heat and pressure fixing device are mutually separated at least when using one of a fine-coated paper and a matt-coated paper as the recording medium.

According to this mode, a desirable heat and pressure fixing process (glossiness adjustment) is carried out in respect of the recording medium of a type which would be damaged by the application of pressure.

Preferably, in a case where a liquid used in the image contains polymer particles, the heat and pressure fixing processing device imparts, to the recording medium, a temperature not lower than a minimum film forming temperature of the polymer particles.

According to this mode, the polymer particles form a film, desirable glossiness is obtained, and the fixing properties of the image are also improved.

Preferably, in a case where a liquid used in the image contains polymer particles, the heat and pressure fixing processing device imparts, to the recording medium, a temperature to not lower than a glass transition point of the polymer particles.

According to this mode, the film formation of the polymer particles progresses yet further, and the fixing properties of the liquid used for the image are further improved.

Preferably, in the pressing process, the switching control device controls the switching device in such a manner that the heat and pressure fixing device is pressed against the recording medium immediately before the image formation region arrives at the contact position, and the heat and pressure fixing device is separated from the recording medium immediately after the image formation region has passed the contact position.

According to this mode, when carrying out the pressing process, distortion due to pressing is eliminated (stress is released) and air is allowed to escape, for each image (recording medium).

Preferably, the fixing processing apparatus further comprises: another heat and pressure fixing device which is arranged in the conveyance path and has functions same with the former heat and pressure fixing device, wherein: the setting device sets at least one of temperature, applying pressure and smoothness of the heat and pressure fixing device on an upstream side in terms of the conveyance direction to be lower than the heat and pressure fixing device on a downstream side in terms of the conveyance direction; and the switching control device controls the switching device to switch between the pressing and the separation independently for each of the heat and pressure fixing devices.

According to this mode, the temperature, applied pressure and smoothness are set in such a manner that the heat and pressure fixing process is carried out in accordance with the progress of drying and fixing of the image, and since the pressing and separation of the heat and pressure fixing device with respect to the recording medium is controlled, then damage to the image caused by the heat and pressure fixing is reduced. Furthermore, by combining the plurality of heat and pressure fixing devices, it is possible to adjust glossiness in accordance with the type of recording medium and the user's preferences.

The smoothness includes the hardness of a smooth surface obtained by coating PAF, or the like, onto the contact surface of the heat and pressure fixing device to the recording medium.

For example, it is possible to combine a mode in which the temperature of the heat and pressure fixing device on the upstream side in terms of the conveyance direction of the recording medium is set to be lower than on the downstream side, a mode where the applied pressure on the upstream side is set to be lower than on the downstream side, and a mode where the smoothness on the upstream side is set to be lower (rougher) than on the downstream side.

Preferably, the fixing processing apparatus further comprises at least two heat and pressure fixing devices which are arranged in the conveyance path and have functions same with the former heat and pressure fixing device, wherein the switching control device controls the switching device so as to use one of upstream two of the heat and pressure fixing devices on a upstream side in terms of the conveyance direction when a recording medium having a first width is used, and to use one of downstream two of the heat and pressure fixing devices on a downstream side in terms of the conveyance direction when a recording medium having a second width broader than the first width is used.

According to this mode, it is possible to apply a suitable pressure even when the width of the recording medium (the dimension in the direction perpendicular to the conveyance direction) is different, and therefore a suitable heat and pressure fixing process can be performed.

For example, the first width is 60% to 80% of the entire compatible width of the apparatus, and the second width is 80% to 100% of the entire compatible width.

Preferably, the fixing processing apparatus further comprises: a reading device which reads in a patch formed in a margin region on the image formation surface; and a temperature measurement device which measures a temperature of the recording medium before and after the heating process and the pressing process in accordance with results obtained by the reading device, wherein the setting device sets the temperature of the heat and pressure fixing device in accordance with whether the pressing process is performed and measurement results of the temperature measurement device. Alternatively, the fixing processing apparatus further comprises: a reading device which reads in a patch formed in a margin region on the image formation surface; and a reflective density measurement device which measures a reflective density of the image formation surface before and after the heating process and the pressing process in accordance with results obtained by the reading device, wherein the setting device sets one of the temperature and the pressure of the heat and pressure fixing device in accordance with whether the pressing process is performed and measurement results of the reflective density measurement device.

According to these modes, it is possible to monitor the temperature and the reflective density stably, irrespective of the image.

If the temperature and the reflective density are monitored in one position on the recording medium, then more accurate adjustment of glossiness becomes possible.

In this mode, a desirable mode is one where the glossiness is measured instead of the reflective density.

Preferably, the heat and pressure fixing device includes a heat roller.

In a mode where the heat and pressure fixing process is carried out without the heat roller making contact with the recording medium, by causing the heat roller to rotate by placing the heat roller in contact with the recording medium after the image portion has passed immediately below the heat roller, it is possible to suppress a locally heated state of the heat roller, and therefore improved efficiency of use of the heat can be expected.

Preferably, the conveyance device includes: a pressure drum which conveys the recording medium in a state of being held on a circumferential surface of the pressure drum in a processing region of the heat and pressure fixing device; and a transfer drum which transfers the recording medium to the pressure drum.

A desirable mode is one where the temperature measurement device and the reflective density measurement device are arranged in a holding member which holds an end portion of the recording medium in the transfer drum.

An inkjet recording apparatus comprises: the fixing processing apparatus; and an image forming device which forms an image on the recording medium.

One example of the image forming device comprises an inkjet head which ejects and deposits ink onto the recording medium, a treatment liquid deposition device which deposits, onto the recording medium, a treatment liquid having a function of fixing the ink on the recording medium by reacting with the ink, and a permeation suppression agent deposition device which deposits, onto the recording medium, a permeation suppression agent having a function of suppressing permeation of the treatment liquid and ink into the recording medium.

When forming color images by using an inkjet head, it is possible to provide heads for each color of a plurality of colored inks (recording liquids), or it is possible to eject inks of a plurality of colors, from one print head.

Preferably, the image forming device forms the image on the recording medium by using a liquid containing polymer particles.

A fixing processing method comprises the steps of: conveying a recording medium in a prescribed conveyance direction along a conveyance path, a desired image having been recorded in an image formation region on an image formation surface of the conveyed recording medium; and carrying out heat and pressure fixing process by a heat and pressure fixing device in which the image formation surface of the recording medium is subjected to at least one of heating process, pressing process and non-pressing process, the heat and pressure fixing device applying pressure to the image formation region while making contact with the image formation surface at a contact position in the conveyance path in the pressing process, the heat and pressure fixing device applying no pressure to the image formation region in the non-pressing process, wherein in the non-pressing process, the recording medium and the heat and pressure fixing device are mutually separated, and a temperature of the heat and pressure fixing device is set to be higher in the non-pressing process than in the pressing process.

The fixing processing method is suitable for an apparatus which processes a recording medium on which an image has been formed using liquid. Furthermore, this method can also be applied to an image forming apparatus which forms an image on a recording medium using liquid.

Preferably, the fixing processing method further comprises the step of emitting air toward the recording medium from a downstream side of the heat and pressure fixing device in terms of the conveyance direction.

Preferably, in the non-pressing process, the heat and pressure fixing device is pressed against the recording medium immediately after the image formation region has passed the contact position.

Preferably, in the non-pressing process, the heat and pressure fixing device is separated from the recording medium after a trailing end portion of the recording medium has passed the contact position and before a leading end portion of a succeeding recording medium arrives at the contact position.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A fixing processing apparatus, comprising:

a conveyance device which conveys a recording medium in a prescribed conveyance direction along a conveyance path, a desired image having been recorded in an image formation region on an image formation surface of the conveyed recording medium;

a control system that selects between a pressing process and a non-pressing process;

a heat and pressure fixing device which is arranged in the conveyance path and carries out heat and pressure fixing process in which the image formation surface of the recording medium is subjected to the selected process between the pressing process and the non-pressing process when the recording medium is conveyed along the conveyance path, wherein in the pressing process, the heat and pressure fixing device is configured to apply pressure to the image formation region while making contact with the image formation surface at a contact position in the conveyance path, and in the non-pressing process, the heat and pressure fixing device is configured to apply no pressure to the image formation region;

a switching device which switches between pressing and separation of the heat and pressure fixing device with respect to the recording medium;

a switching control device, included in said control system, which controls the switching device in such a manner that the recording medium and the heat and pressure fixing device are mutually separated in the non-pressing process; and a setting device, included in said control system, which sets a heating process temperature of the heat and pressure fixing device to be higher in the non-pressing process than in the pressing process applied when the recording medium is conveyed along the conveyance path.

2. The fixing processing apparatus as defined in claim 1, further comprising an air emitting device which emits air toward the recording medium and is arranged in the conveyance path on a downstream side of the heat and pressure fixing device in terms of the conveyance direction.

3. The fixing processing apparatus as defined in claim 1, wherein in the non-pressing process, the switching control device controls the switching device in such a manner that the heat and pressure fixing device is pressed against the recording medium immediately after the image formation region has passed the contact position.

4. The fixing processing apparatus as defined in claim 3, wherein in the non-pressing process, the switching control device controls the switching device in such a manner that the heat and pressure fixing device is separated from the recording medium after a trailing did portion of the recording medium has passed the contact position and before a leading end portion of a succeeding recording medium arrives at the contact position.

5. The fixing processing apparatus as defined in claim 1, wherein the switching control device controls the switching device in such a manner that the recording medium and the heat and pressure fixing device are mutually separated at least when using one of a fine-coated paper and a matt-coated paper as the recording medium.

6. The fixing processing apparatus as defined in claim 1, wherein in a case where a liquid used in the image contains polymer particles, the heat and pressure fixing processing device imparts, to the recording medium, a temperature not lower than a minimum film forming temperature of the polymer particles.

7. The fixing processing apparatus as defined in claim 1, wherein in a case where a liquid used in the image contains polymer particles, the heat and pressure fixing processing device imparts, to the recording medium, a temperature not lower than a glass transition point of the polymer particles.

8. The fixing processing apparatus as defined in claim 1, wherein in the pressing process, the switching control device controls the switching device in such a manner that the heat and pressure fixing device is pressed against the recording medium immediately before the image formation region arrives at the contact position, and the heat and pressure fixing device is separated from the recording medium immediately after the image formation region has passed the contact position.

9. The fixing processing apparatus as defined in claim 1, further comprising:

another heat and pressure fixing device which is arranged in the conveyance path and has functions same with the heat and pressure fixing device in claim 1, wherein:

the setting device sets at least one of temperature, applying pressure and smoothness of the heat and pressure fixing device on an upstream side in terms of the conveyance direction to be lower than the heat and pressure fixing device on a downstream side in terms of the conveyance direction; and the switching control device controls the switching device to switch between the pressing and the separation independently for each of the heat and pressure fixing devices.

10. The fixing processing apparatus as defined in claim 1, further comprising at least two heat and pressure fixing devices which are arranged in the conveyance path and have functions same with the heat and pressure fixing device in claim 1, wherein the switching control device controls the switching device so as to use one of upstream two of the heat and pressure fixing devices on a upstream side in terms of the conveyance direction when a recording medium having a first width is used, and to use one of downstream two of the heat and pressure fixing devices on a downstream side in terms of the conveyance direction when a recording medium having a second width broader than the first Width is used.

11. The fixing processing apparatus as defined in claim 1, further comprising:

a reading device which reads in a patch formed in a margin region on the image formation surface; and a temperature measurement device which measures a temperature of the recording medium before and after the heating process and the pressing process in accordance with results obtained by the reading device, wherein the setting device sets the temperature of the heat and pressure fixing device in accordance with whether the pressing process is performed and measurement results of the temperature measurement device.

12. The fixing processing apparatus as defined in claim 1, further comprising:

a reading device which reads in a patch formed in a margin region on the image formation surface; and a reflective density measurement device which measures a reflective density of the image formation surface before and after the heating process and the pressing process in accordance with results obtained by the reading device, wherein the setting device sets one of the temperature and the pressure of the heat and pressure fixing device in accordance with whether the pressing process is performed and measurement results of the reflective density measurement device.

13. The fixing processing apparatus as defined in claim 1, wherein the heat and pressure fixing device includes a heat roller.

14. The fixing processing apparatus as defined in claim 1, wherein the conveyance device includes:

a pressure drum which conveys the recording medium in a state of being held on a circumferential surface of the pressure drum in a processing region of the heat and pressure fixing device; and a transfer drum which transfers the recording medium to the pressure drum.

15. An inkjet recording apparatus, comprising:

the fixing processing apparatus as defined in claim 1; and an image forming device which forms an image on the recording medium.

16. The inkjet recording apparatus as defined in claim 15, wherein the image forming device forms the image on the recording medium by using a liquid containing polymer particles.

17. A fixing processing method, comprising the steps of:

conveying a recording medium in a prescribed conveyance direction along a conveyance path, a desired image having been recorded in an image formation region on an image formation surface of the conveyed recording medium;

selecting between a pressing process and a non-pressing process; and carrying out a heat and pressure fixing process by a heat and pressure fixing device in which the image formation surface of the recording medium is subjected to the selected process between the pressing process and the non-pressing process when the recording medium is conveyed along the conveyance path, the heat and pressure fixing device applying pressure to the image formation region while making contact with the image formation surface at a contact position in the conveyance path in the pressing process, the heat and pressure fixing device applying no pressure to the image formation region in the non-pressing process, wherein in the non-pressing process, the recording medium and the heat and pressure fixing device are mutually separated, and a heating process temperature of the heat and pressure fixing device is set to be higher in the non-pressing process than in the pressing process applied when the recording medium is conveyed along the conveyance path.

18. The fixing processing method as defined in claim 17, further comprising the step of emitting air toward the recording medium from a downstream side of the heat and pressure fixing device in terms of the conveyance direction.

19. The fixing processing method as defined in claim 17, wherein in the non-pressing process, the heat and pressure fixing device is pressed against the recording medium immediately after the image formation region has passed the contact position.

20. The fixing processing method as defined in claim 19, wherein in the non-pressing process, the heat and pressure fixing device is separated from the recording medium after a trailing end portion of the recording medium has passed the contact position and before a leading end portion of a succeeding recording medium arrives at the contact position.

* * * * *